US009376796B2

(12) United States Patent
Ma

(10) Patent No.: US 9,376,796 B2
(45) Date of Patent: Jun. 28, 2016

(54) RAPIDLY DEPLOYABLE STRUCTURES BASED UPON NEGATIVE POISSON'S RATIO (NPR) AUXETIC COMPONENTS

(71) Applicant: Zheng-Dong Ma, Ann Arbor, MI (US)

(72) Inventor: Zheng-Dong Ma, Ann Arbor, MI (US)

(73) Assignee: MKP Structural Design Associates, Inc., Dexter, MI (US)

( * ) Notice: Subject to any disclaimer, the term of this patent is extended or adjusted under 35 U.S.C. 154(b) by 91 days.

(21) Appl. No.: 13/650,841

(22) Filed: Oct. 12, 2012

(65) Prior Publication Data

US 2013/0322955 A1 Dec. 5, 2013

Related U.S. Application Data

(60) Provisional application No. 61/546,834, filed on Oct. 13, 2011.

(51) Int. Cl.

| | |
|---|---|
| ***E04H 15/44*** | (2006.01) |
| ***E04B 1/19*** | (2006.01) |
| ***E04B 1/344*** | (2006.01) |
| ***E04C 3/00*** | (2006.01) |
| ***E04C 2/36*** | (2006.01) |

(52) U.S. Cl.

CPC ..... *E04B 1/1903* (2013.01); *E04B 1/3441* (2013.01); *E04C 2/365* (2013.01); *E04C 3/005* (2013.01); *E04H 15/44* (2013.01); *Y10T 403/32008* (2015.01)

(58) Field of Classification Search

CPC ..... E04B 7/08; E04B 7/10; E04B 1/19; E04B 1/343; E04H 15/44; E04H 15/48; E04C 2/365; E04C 3/005; Y10T 403/32008

USPC ..... 135/121–123, 128, 130, 143–144, 151, 135/157, 120.3; 52/80.1, 81.1–81.5, 633, 52/635, 641, 645, 646, 649.5, 652.1; 403/170–171, 173, 177, 217–219

See application file for complete search history.

(56) References Cited

U.S. PATENT DOCUMENTS

| | | | | |
|---|---|---|---|---|
| 3,675,667 | A | 7/1972 | Miller | |
| 3,771,274 | A * | 11/1973 | Vaughan | 52/646 |
| 3,968,808 | A * | 7/1976 | Zeigler | 135/145 |
| 4,241,746 | A * | 12/1980 | Rothe | 135/147 |
| 4,471,548 | A * | 9/1984 | Goudie | 40/610 |

(Continued)

FOREIGN PATENT DOCUMENTS

WO WO-2005079146 9/2005

*Primary Examiner* — Winnie Yip

(74) *Attorney, Agent, or Firm* — Dinsmore & Shohl LLP

(57) ABSTRACT

Reconfigurable, expandable-collapsible structures based upon negative Poisson's ratio (NPR) auxetic unit cells achieve rapidly deployable apparatus, devices and systems. A plurality of joint bodies, each joint body having a plurality of connection features, are coupled to interconnecting link members with opposing ends, each end including connection features that engage with the connection features of the joint bodies. The link members pivot about different axes relative to the joint bodies, thereby forming an expandable and collapsible structure having a height and a width. The link members form an array of geometric unit cells when the structure is expanded, and the height and the width of the structure when expanded are both greater than the height and the width of the structure when collapsed. In certain embodiments the structures have unit cells based upon triangles or bowtie shapes.

23 Claims, 28 Drawing Sheets

(56) References Cited

U.S. PATENT DOCUMENTS

| | | | | | |
|---|---|---|---|---|---|
| 4,475,323 | A | * | 10/1984 | Schwartzberg et al. | 52/111 |
| 4,539,786 | A | * | 9/1985 | Nelson | 52/645 |
| 4,655,022 | A | * | 4/1987 | Natori | 52/646 |
| 4,707,953 | A | | 11/1987 | Anderson et al. | |
| 4,901,481 | A | | 2/1990 | Seeley, Jr. | |
| 5,184,444 | A | * | 2/1993 | Warden | 52/646 |
| 5,228,258 | A | * | 7/1993 | Onoda et al. | 52/646 |
| 5,921,388 | A | | 7/1999 | Petrilli et al. | |
| 6,141,934 | A | * | 11/2000 | Zeigler | 52/646 |
| 6,192,633 | B1 | | 2/2001 | Hilbert | |
| 6,360,760 | B1 | | 3/2002 | Louie et al. | |
| 6,892,744 | B2 | | 5/2005 | Feldpausch et al. | |
| 7,389,621 | B2 | | 6/2008 | Hawes | |
| 7,533,681 | B2 | * | 5/2009 | Miller | 135/130 |
| 7,578,111 | B2 | | 8/2009 | Hawes | |
| 7,644,721 | B2 | | 1/2010 | Hoberman et al. | |
| 7,910,193 | B2 | | 3/2011 | Ma | |
| 7,941,974 | B2 | | 5/2011 | VanBasten et al. | |
| 7,963,084 | B2 | * | 6/2011 | Merrifield et al. | 52/646 |
| 2005/0115186 | A1 | * | 6/2005 | Jensen et al. | 52/633 |
| 2007/0044415 | A1 | * | 3/2007 | Merrifield et al. | 52/633 |
| 2010/0119792 | A1 | * | 5/2010 | Ma | 428/218 |
| 2010/0126545 | A1 | | 5/2010 | Bullivant et al. | |

* cited by examiner

Square

Honeycomb

Octagonal

Ten-side polygon

Two Types of Joint

Sketch of a planar N-axle Joint
(Axis angles can be same or different)

Sketch of a M-layer joint
(Each layer can have multiple axles)

Male-Male

Female-Male

Female-Female

Male-Female

RAPIDLY DEPLOYABLE STRUCTURES BASED UPON NEGATIVE POISSON'S RATIO (NPR) AUXETIC COMPONENTS

REFERENCE TO RELATED APPLICATION

This application claims priority from U.S. Provisional Patent Application Ser. No. 61/546,834, filed Oct. 13, 2011, the entire content of which is incorporated herein by reference.

FIELD OF THE INVENTION

This invention relates generally to negative Poisson's ratio (NPR) auxetic structures and, in particular, to rapidly deployable apparatus, devices and systems based upon these structures.

BACKGROUND OF THE INVENTION

People have long been fascinated with structures and forms which are easily collapsible and/or readily expandable. A pioneer in this field is Chuck Hoberman, now affiliated with Hoberman Associates. Hoberman holds several U.S. patents relating to 'reversibly expandable structures,' including radially expanding trusses. Hoberman's initial patents dealt with transformability in structures. In 2008, Hoberman founded Adaptive Building Initiative with Buro Happold to design rapidly transformable buildings, which led to the construction of the POLA Ginza Building's adaptive façade in 2009. Three more of Hoberman's adaptive shading installations were constructed in 2010, including the Aldar Central Market, the Wyss Institute at Harvard, and the Simons Center at Stony Brook University.

Johnson Outdoors of Racine, Wis., a manufacturer of tents for both government and consumer markets, approached Hoberman Associates in 2005 to develop a new line of large shelters for military use and crisis relief. This led to the development of Rapidly Deployable Shelters (RDS) under Johnson's Eureka brand. With easier deployment and minimal time-consuming secondary connections, the RDS system uses fewer, larger, and more robust parts than competitive products. The RDS comes in several sizes, the largest of which deploys to 750 square feet, and folds down to a 3 foot by 3½ foot by 6 foot compact bundle.

U.S. Pat. No. 7,644,721 to Hoberman et al. is directed to tents and the provision of temporary shelter. The particular problem addressed in the patent relates to extensible tong linkages, sometimes referred to as scissor linkages which are used to construct transformable truss-structures in a variety of shapes. While such scissor linkages are effective in creating structures that deploy or transform, once the structure is deployed, they are less effective in providing an optimum structural system. This is due to the fact that the "structural depth" of a scissor linkage varies widely. In some places, there is significant distance between its links while in other places, both links overlap such that there is no depth provided beyond the individual link dimensions. This results in a basic structural inefficiency. Such inefficiency can limit the structural span, lead to increased weight, and prevent efficient packaging.

The '721 patent describes a system based on parallel, four-bar linkages. The invention relates to means of connecting series of four-bar linkages together such that they provide a structural truss in their extended state, provide a compact package in their retracted state, and move together in a synchronized fashion. The mechanism is comprised of two or more four-bar linkages wherein each linkage shares a common link with each adjacent linkage and the movement of said two or more linkages is synchronized by mechanical means such that said mechanism may move between a collapsed and an extended state. The mechanical means may be in the form of additional links or geared connections. The patent further discloses means to cause the mechanism, when in its extended state, to become stiff and structural. Fabric elements may be attached to these mechanisms to form rapidly deployable shelters.

Another commercially available rapidly deployable shelter is called DRASH (Deployable Rapid Assembly Shelter), a portable, geodesic shelter that can be set up within minutes of arriving on site with no special tools. The system is manufactured and sold by DHS Systems LLC (Orangeburg, N.Y.). The structures, which are supported by composite struts, have footprints from 109 sq ft (10.1 $m^2$) up to 1,250 sq ft (116 $m^2$). Each DRASH shelter comes with flooring and ground covers manufactured from polyester and nylon to U.S. military standards. DRASH also provides generators and trailers plus various accessories for the shelters themselves. For transport or storage, the shelters pack down to less than 2% of its deployed size into a transport bag that can be stowed on a trailer or HMMWV. Teams of four to six can easily erect a shelter simply by pulling on the sides of the shelter and raising the shelter in designated "push points" on the shelter.

The above examples are only a few of many more in the field of rapidly deployable structures, shelters, tents and other temporary or emergency dwellings. Other examples include, for example, inflatable components.

Commonly assigned U.S. Pat. No. 7,910,193, relates to negative Poisson's ratio (NPR) or auxetic structures and, in particular, to three-dimensional auxetic structures and applications thereof. Poisson's ratio ($\nu$), named after Simeon Poisson, is the ratio of the relative contraction strain, or transverse strain (normal to the applied load), divided by the relative extension strain, or axial strain (in the direction of the applied load). Some materials, called auxetic materials, have a negative Poisson's ratio (NPR). If such materials are stretched (or compressed) in one direction, they become thicker (or thinner) in perpendicular directions.

NPR structures can react differently under applied loads. One possibility is a reactive shrinking mechanism, obtained through a topology optimization process. The unique property of this structure is that it will shrink in two directions if compressed in one direction. Auxetic and NPR structures have been used in a variety of applications. Heretofore, however, such structures have not been exploited for use in rapidly deployable shelters and components used in such structures.

SUMMARY OF THE INVENTION

This invention relates generally to negative Poisson's ratio (NPR) auxetic structures and, in particular, to rapidly deployable apparatus, devices and systems based upon these structures. An expandable-collapsible structure constructed in accordance with the invention includes a plurality of joint bodies, each joint body having a plurality of connection features. A plurality of interconnecting link members are provided with opposing ends, each end including connection features that engage with the connection features of the joint bodies such that the link members pivot about different axes relative to the joint bodies, thereby forming an expandable and collapsible structure having a height and a width. The link members form an array of geometric unit cells when the structure is expanded, and the height and the width of the structure when expanded are both greater than the height and the width of the structure when collapsed.

In preferred embodiments, some of the interconnecting link members form parallel, straight lines when the structure is expanded. For example, structures having unit cells based upon triangles or bowtie shapes for substantially straight, parallel lines when expanded. In such embodiments, the interconnecting link members have side edges which are proximate to one another or touching only when the structure is collapsed.

The interconnecting link members may be rigid or flexible; straight or curved, and may have uniform or varied cross sections. The joint bodies with connection features and pivot axes may be arranged on different levels or planes. The structure may further include a flexible sheet of material adhered to the joint bodies, link members, or both, thereby forming a covered panel when the structure is expanded. The material may be waterproof or weather-resistant, and the panels may be configured to form a building, tent, shelter, storage unit, mobile house, vehicle body or other enclosure.

A joint in general may have one or multiple layers refer to different levels or planes. Possible examples include one-layer, two-layer, three-layer and four-layer joints with the understanding that additional levels are possible with sufficient stepped outer profiling. Each layer of the joint may have multiple axles with different (including same) axial directions defined by the axis angles. Each of the joint bodies may utilize any number of different joint types; for example, joint types having male-female, female-female, female-male and male-male interconnection configurations, various clicking joints, and different types of pin connections.

The connection features may include posts or projections, with holes or recesses being configured to receive the posts or projections. Alternatively, the connection features may comprise pins disposed along the pivot axes. The ends of the link members may include two arms with connection features, enabling the arms are temporarily spread apart to engage with the connection features on the joint bodies, resulting in "snap-in" connections.

The link members form an array of geometric unit cells having a periodicity when the structure is expanded, and the periodicity may vary in one or more dimensions. The number of unit cells within a layer of unit cells may define a height of that layer, with the height being the same or different with respect to different layers. The unit cells may also define a width when the structure is expanded, with the width being uniform or variable in one or more dimensions. The link members may be constructed from metals, ceramics, fiber-reinforced composite materials, polymer matrix materials, plastics, or fibers. The structure may further include foam or other filler material surrounding the link members FIG. 1, "160"). The structure has an outermost surface when expanded, and the outermost surface may be cylindrical or curved in one or more dimensions. The link members have cross sections, and the cross sections may define solid or hollow rods or tubes, flat or curved plates or strips, or U-shaped, T-shaped, V-shaped or I-shaped beams.

DETAILED DESCRIPTION OF THE INVENTION

Figures 1, 2:
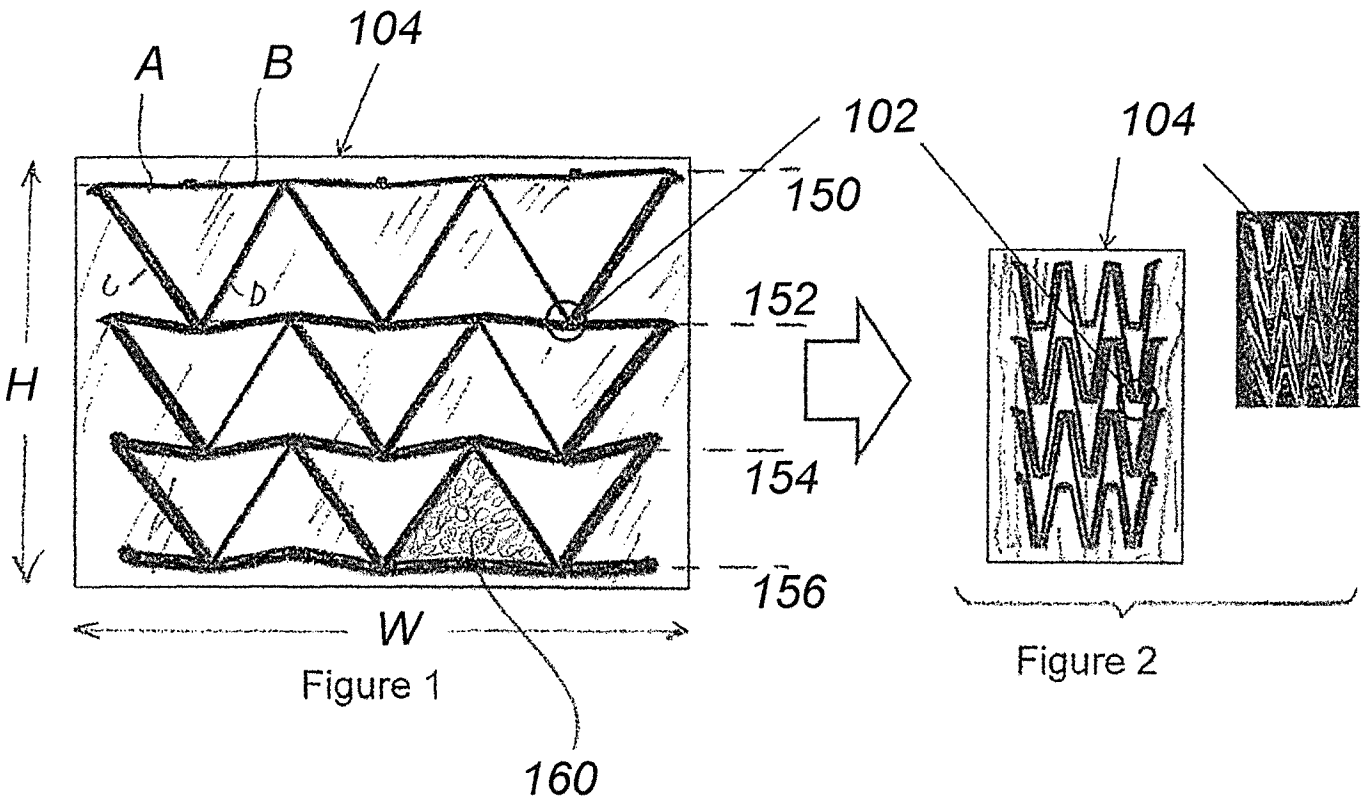
FIG. 1 illustrates a collapsible panel based upon a "nested-V" auxetic structure in and expanded form.
FIG. 2 show the panel of FIG. 1 in a collapsed state.

This invention improves upon rapidly deployable structures by providing components based upon negative Poisson's ratio (NPR) auxetic designs. FIGS. 1 and 2 illustrate a first such design based upon a "nested-V" configuration. FIG. 1 shows the structure in an expanded form, whereas FIG. 2 shows the structure in a collapsed state. In the collapsed state of FIG. 2, the structure assumes a width (W) reduction on the order of 70%. Being an auxetic in nature, a height (H) reduction is also evident from the diagrams.

The configuration of FIGS. 1, 2 is based upon an array of unit cells, each of which includes two shorter members (i.e., A, B) connected by joint bodies 102 forming a smaller V-shape and two longer members (i.e., C, D), also connected by joints, forming a larger V-shape. In the preferred embodiments members A, B are substantially the same length, as are members C, D, and all of the members are straight. However, in alternative embodiments the members may be of different lengths and may be curved or otherwise 'non-straight.' Note in the expanded state of FIG. 1 that the nested V-shapes are nearly triangular, while in the collapsed state of FIG. 2 the members associated with each unit cell assume a more parallel arrangement wherein the sides of the members are proximate to one another, if not touching in some cases. It is also worth noting that in this and other designs, some of the members form substantially parallel lines 150, 152, 154, 156 in the expanded state.

To provide a structural building element such as a wall component, a fabric 104 or other cover may be attached to the V-shapes, preferably at the joints 102, so as to realize a panel structure that may readily expand and collapse. Alternatively, the fabric material may be bonded to the sides of the various members. Although only one fabric sheet is depicted in FIGS. 1 and 2, a second sheet may be provided on the opposing side, thereby creating a trapped air space which may be filled with insulative material(s). As seen in FIG. 1, in the expanded state the flexible sheet is substantially unfolded, whereas in the collapsed states of FIG. 2, the sheet is folded along with the structure itself.

The members and joint bodies may be made out of any suitable material such as plastics, metals or wood. The members may be solid or hollow. Any type of fabric may be used, including canvas, nylon, and so forth. In lightweight implementations for shelters, tents, and the like, one preferred combination comprises aluminum interconnecting members, aluminum or plastic joint bodies, and rip-stop nylon fabric.

Figure 3:
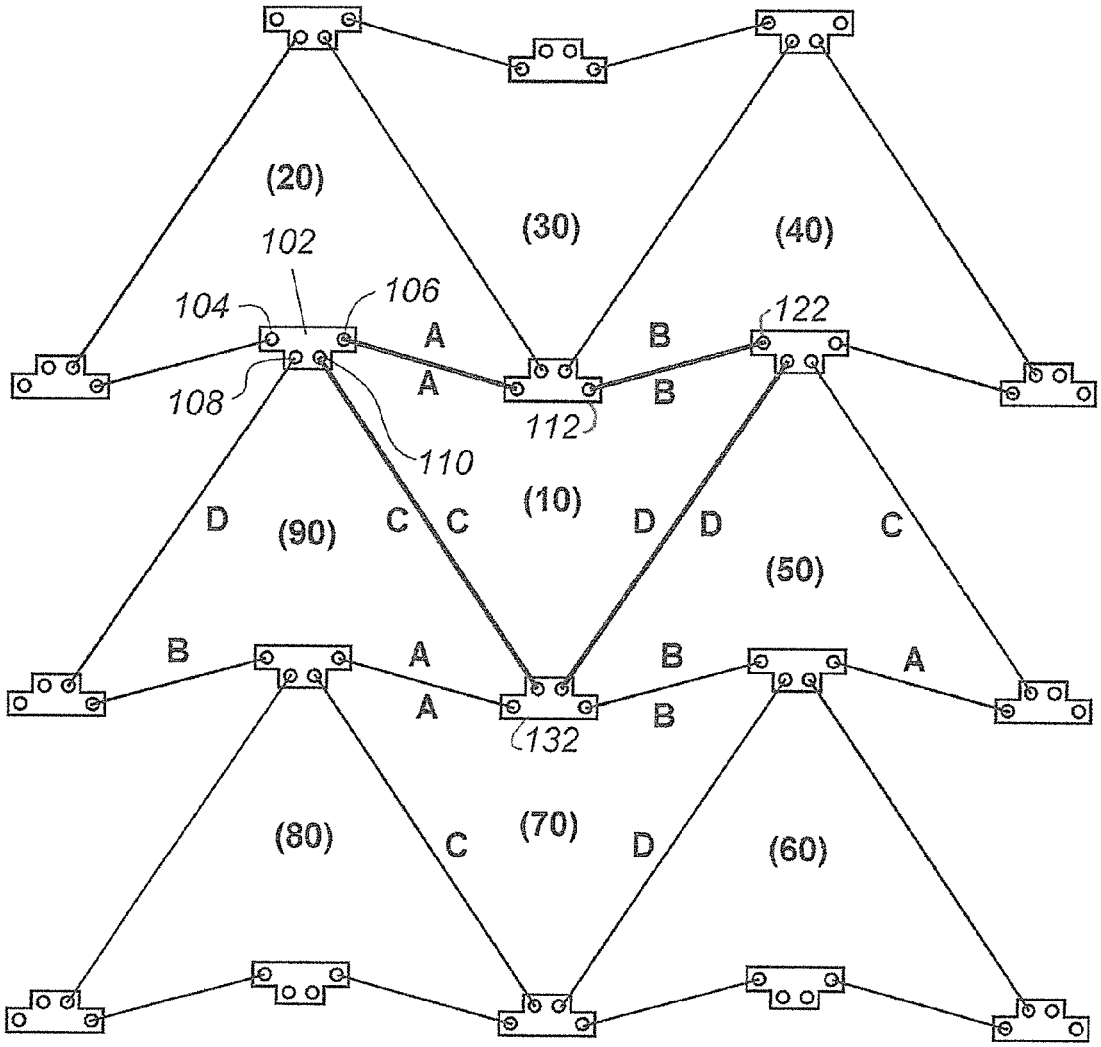
FIG. 3 is a detailed diagram which better illustrates the way in which unit cells according to the invention are constructed and how they interact.

FIG. 3 is a more detailed diagram which better illustrates the way in which the unit cells are constructed and how they interact. Note that while this description may use terms such as upper, lower, right, left, lateral, vertical, inverted, forward, rear, etc., the reader should understand that these are for description only and that all of the structures disclosed herein may be oriented in any direction. Unit cell 10, in the middle of FIG. 3, includes upper members A, B and lower members C, D. Members A, B are connected with joint 112, members C, D are connected with joint 132, members A, C are connected with joint 102, and members B, D are connected with joint 122. In this case, all of the joint bodies 102, 112, 122, 132 may be the same.

Each member is pivotally coupled to two joints, one at each respective end of each member. Using joint 102 as an example, the joint includes two opposing connection points 104, 106 for shorter members and two connection points 108, 110 for longer members. These connections may be made in any appropriate manner, including nuts and bolts, rivets, spring pins or, as shown in subsequent Figures, with spring-action, clip-on arrangements.

Note that in FIG. 3, unit cell 10 shares its two longer members with inverted cells 90, 50 on either side. Unit cell 10 further shares its shorter member A with member A of cell 20, and shares its shorter member B with member B of cell 40. Unit cell 10 further shares its shorter member A with member A of invented cell 20, and shares its shorter member B with member B of inverted cell 40. In addition, joint 112 is shared by cells 10, 20, 30, 40; joint 132 is shared by cells 10, 50, 70, 90, and so on.

Figure 4A:
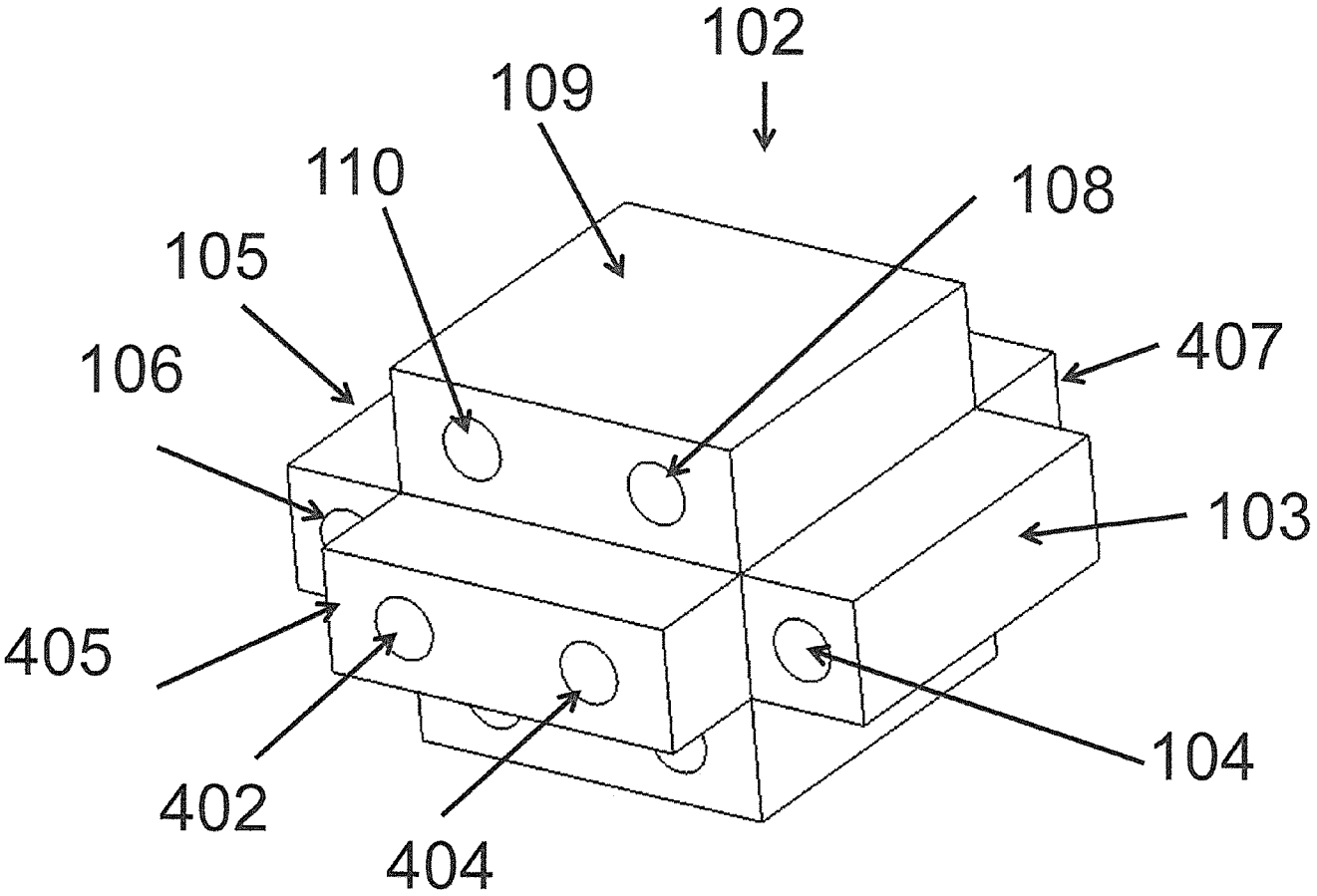
FIG. 4A is a detailed, oblique drawing of a joint body.
Figure 4B:
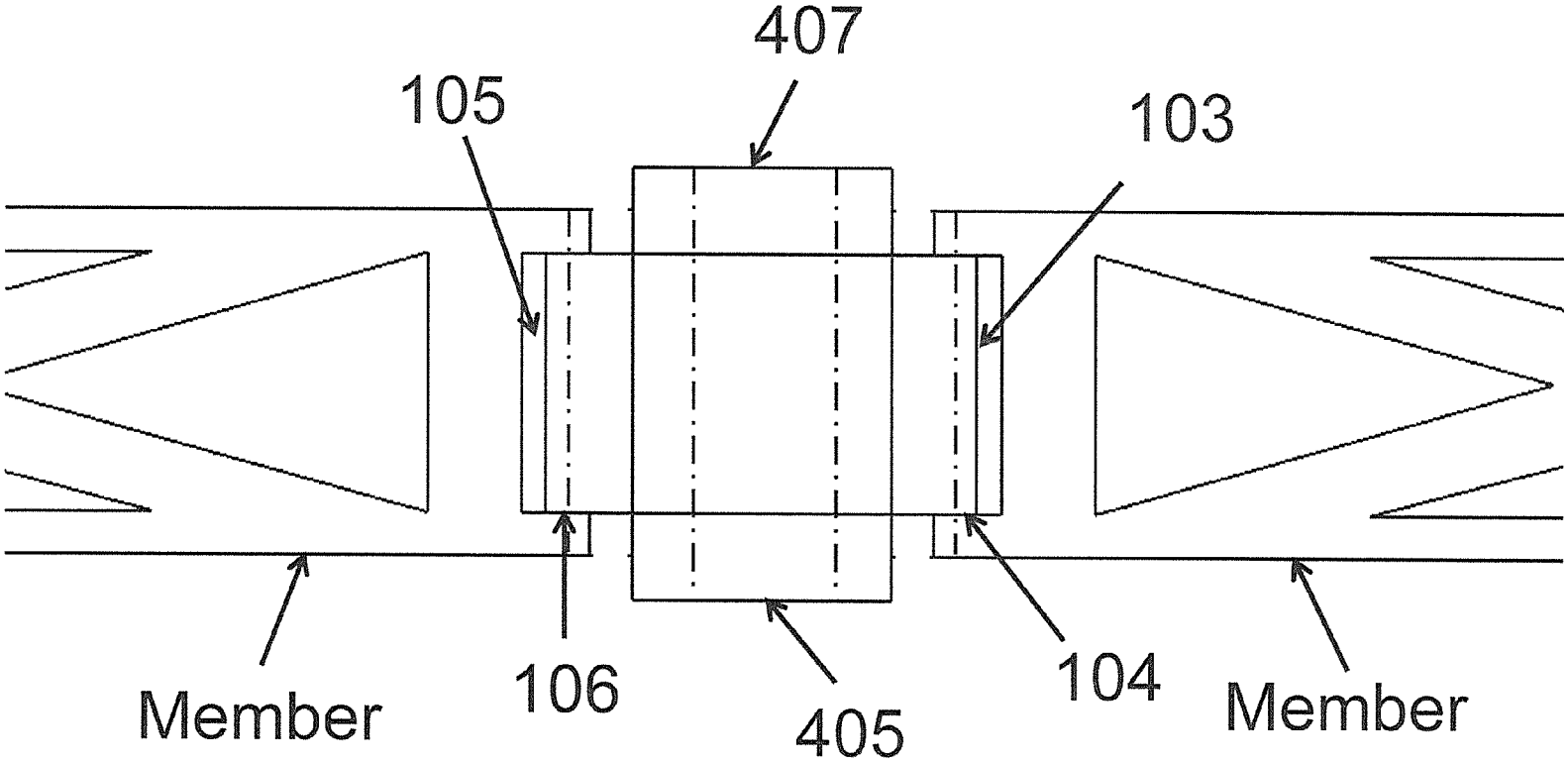
FIG. 4B illustrates the way in which connecting members attach to a joint body.
Figure 4C:
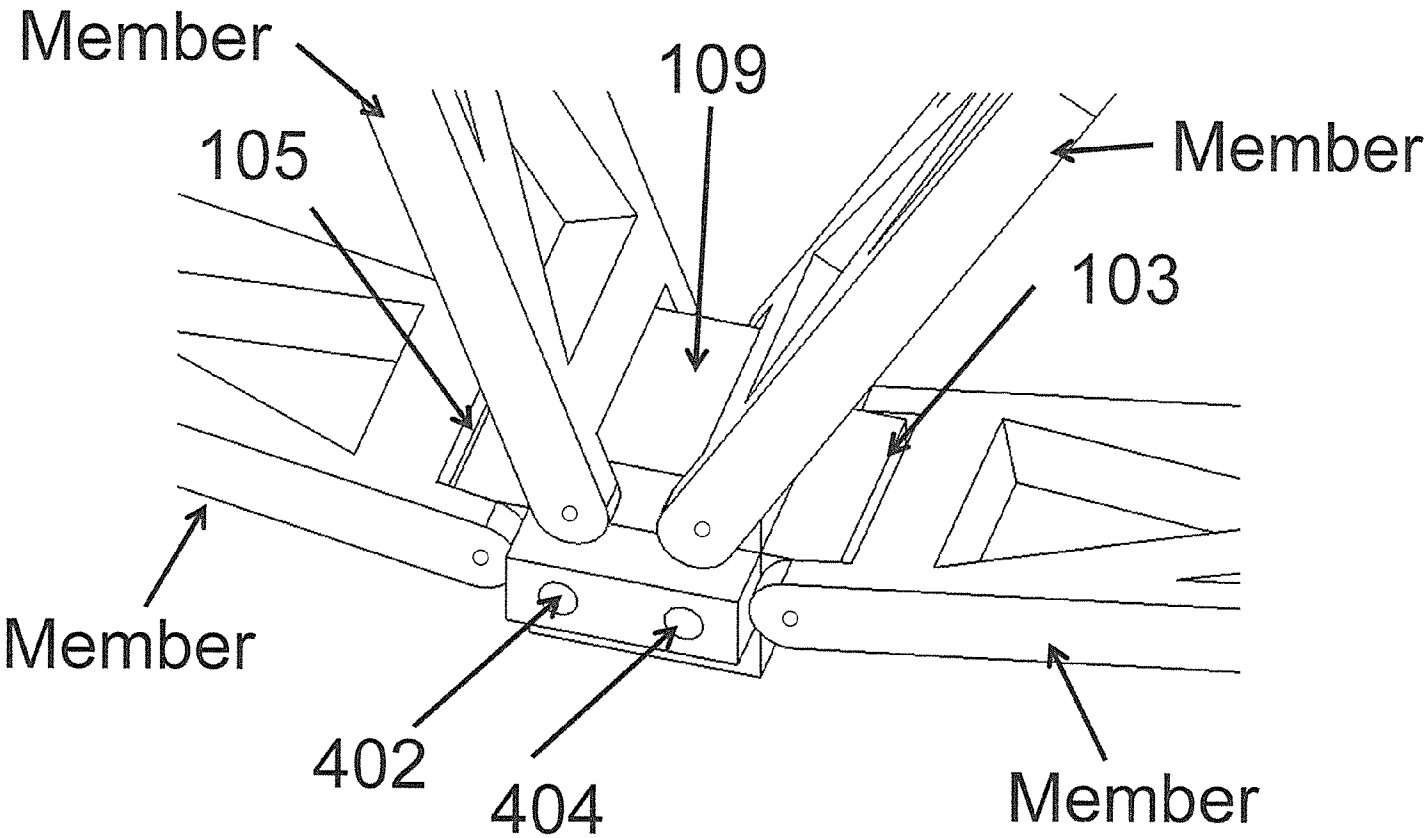
FIG. 4C shows a plurality of interconnecting members coupled to the joint body of FIG. 4A.

FIG. 4A is an oblique drawing of a body 102' similar to that shown in FIG. 3, but with additional connection points to achieve additional structural arrangements. The body, which may be made of any hard, durable material such as metal or plastic, includes an upper portion 109 with connection points 108, 110, and two side extensions 103, 105 with connection points 104, 106. Forward and rear extensions 405, 407 with connection points 402, 404 allow the connections with the members to be flush as shown in the top-down and oblique views of FIGS. 4B and 4C.

Figure 5:
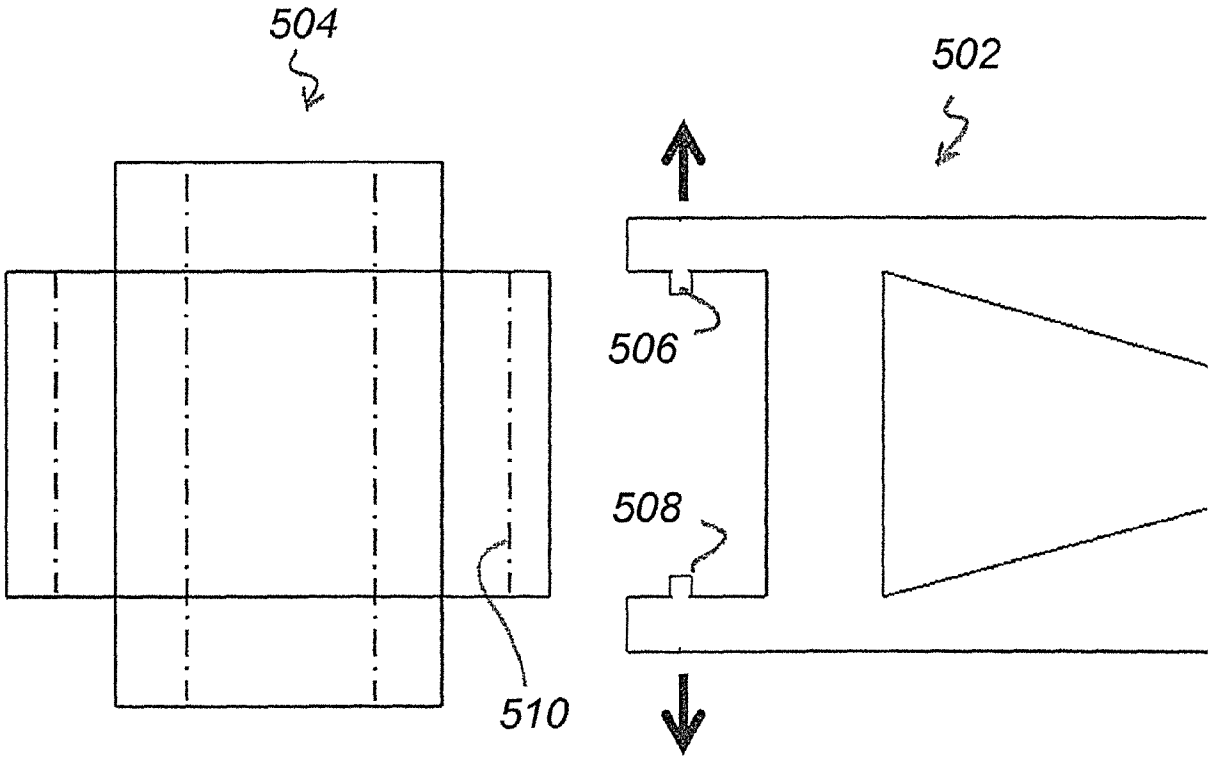
FIG. 5 depicts the way in which interconnecting members may snap into a joint body.

FIG. 5 depicts the way in which an interconnecting member 502 may snap into a joint body 504. In this case the ends of the member 502 are temporarily spread apart enabling projections, posts or pins 506, 508 to be received by opposing openings in the body 504 represented by the axis 510 of a hole through the body. Note that the hole need not penetrate entirely through the body so long as appropriate corresponding depressions, recesses, or cavitations are provided.

Figure 6:
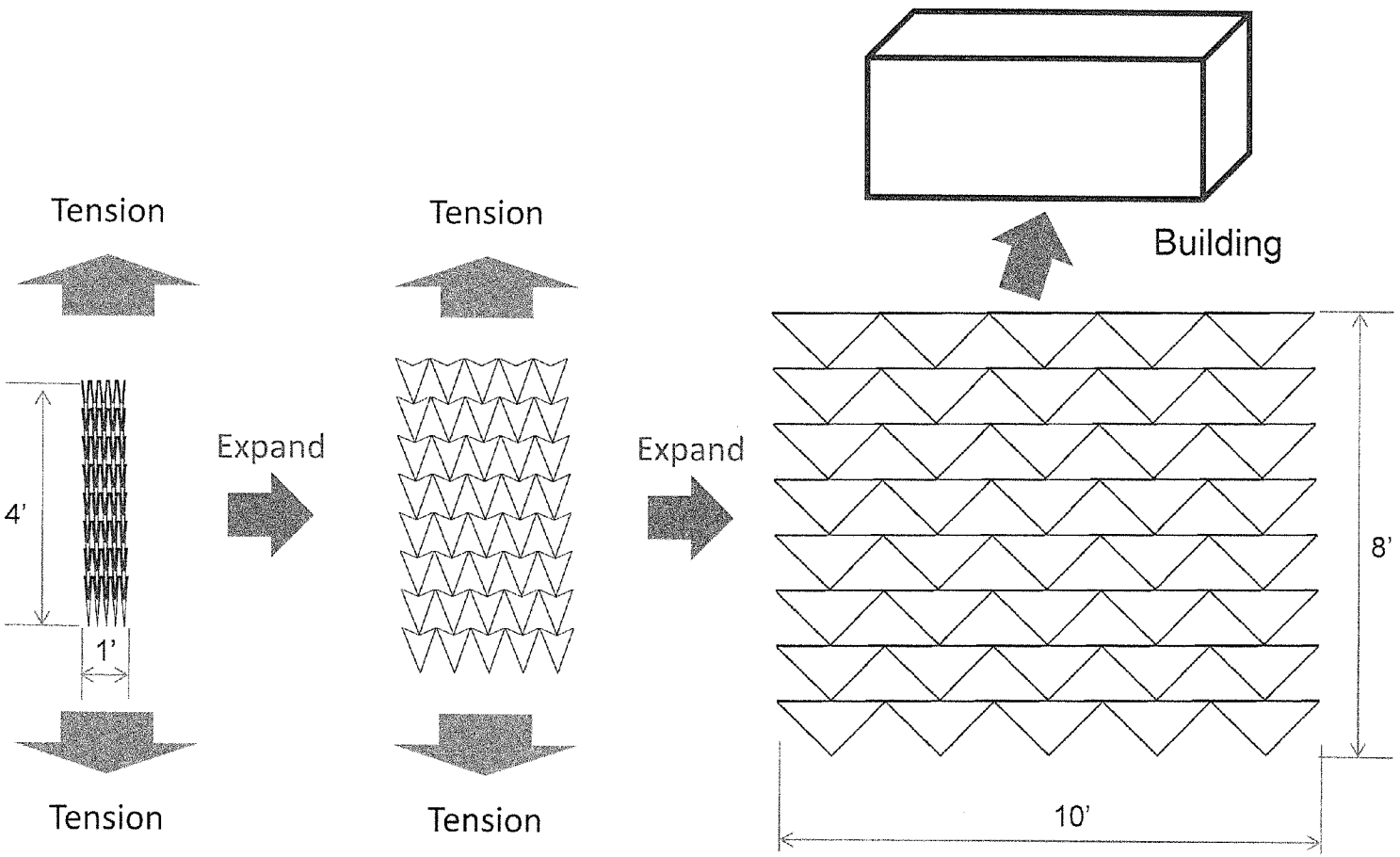
FIG. 6 illustrates the progressive expansion of a V-type auxetic panel.

As mentioned, for larger structures, geometries may be adjusted to suit different applications. For example, as shown in FIG. 6, an auxetic panel measuring just 1 foot by 4 feet may be expanded into a wall panel measuring 10 feet by 8 feet. Once expanded, the panels may be joined through any appropriate edge connections to produce walls for buildings, ceilings, and so forth.

Figure 7:
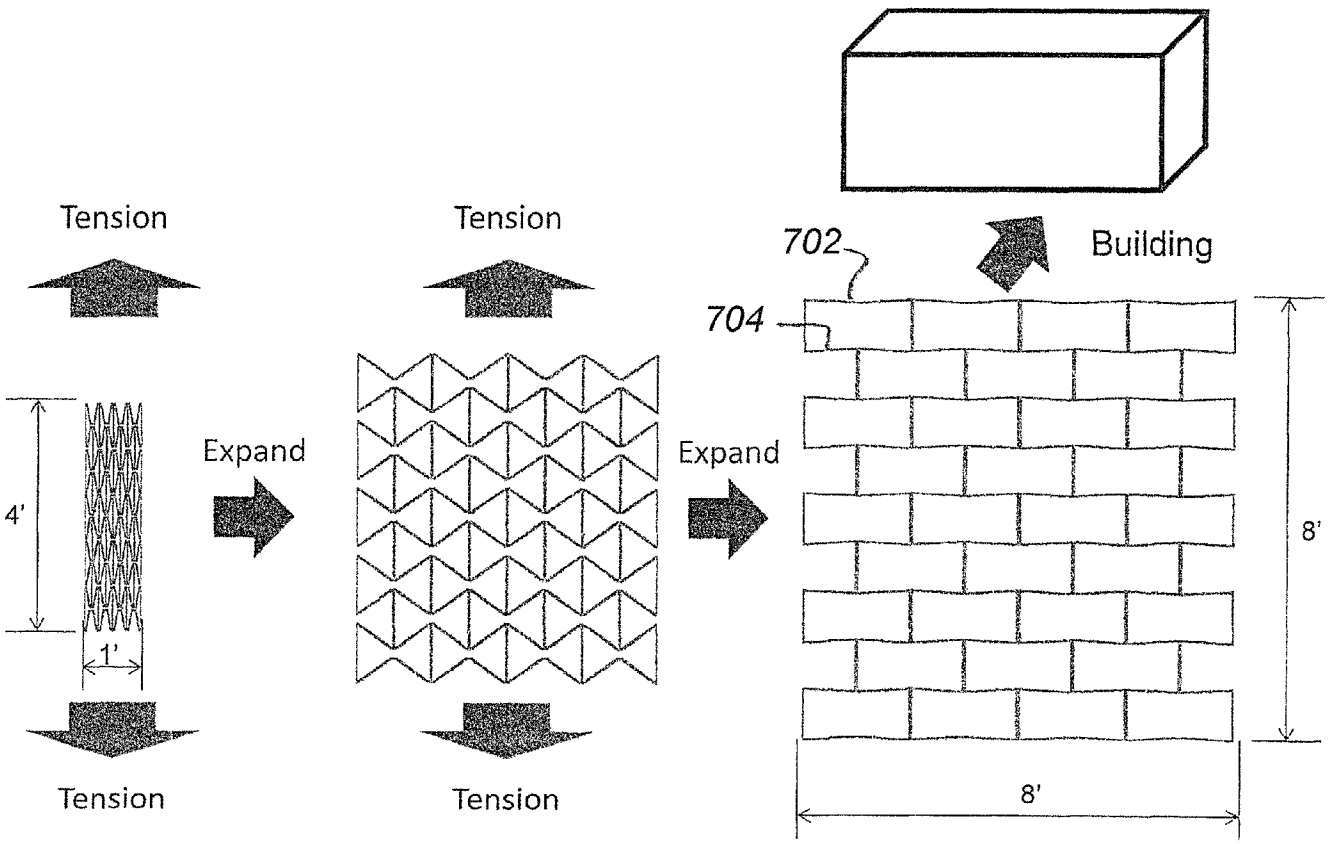
FIG. 7 shows an auxetic panel based upon a X- or "bowtie"-shape type of unit cell.

FIG. 7 shows an auxetic panel based upon a different type of unit cell, in this case an X- or "bowtie" shape. The figure shows the panel in the contract and expanded conditions. As in FIG. 6, such a panel measuring just 1 foot by 4 feet may be expanded into a wall panel measuring 10 feet by 8 feet. Further, as with the array of V-shapes, some of the members of the bowtie configuration form substantially parallel lines 702, 704, etc. upon assuming the expanded configuration.

Figure 8:
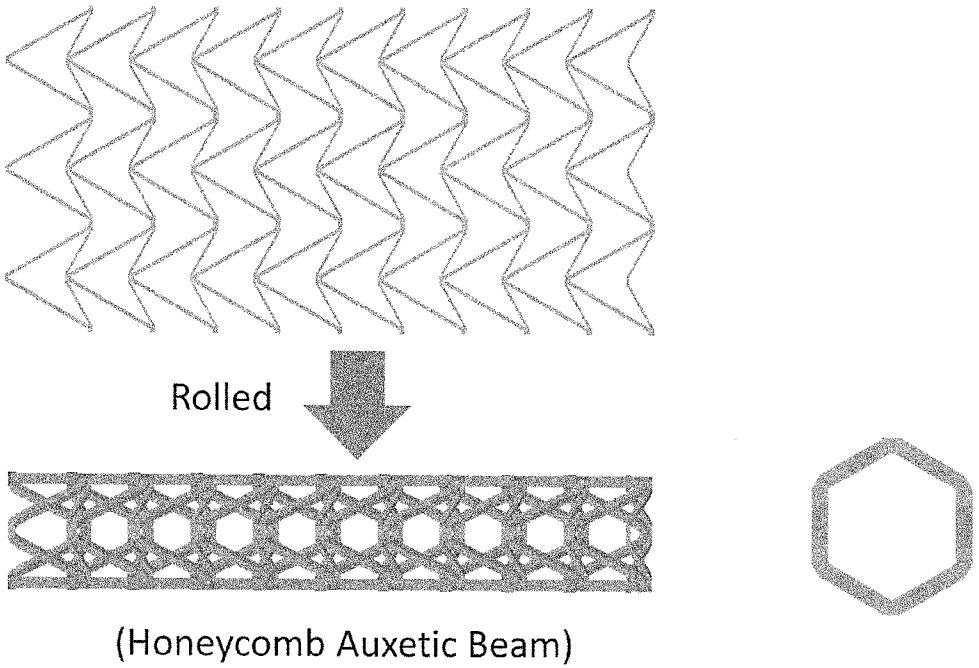
FIG. 8 depicts the nested-V cell used in a cylindrical configuration to construct a honeycomb auxetic beam.
Figure 9A:
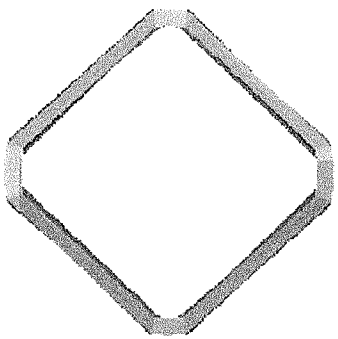
FIG. 9A shows an expanded auxetic beam having a square cross section.
Figure 9B:
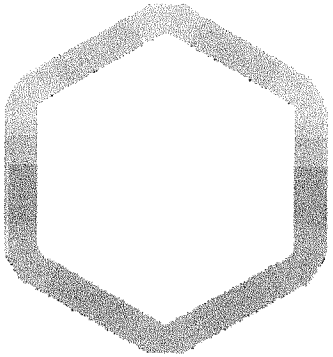
FIG. 9B shows an expanded auxetic beam having a hexagonal or honeycomb cross section.
Figure 9C:
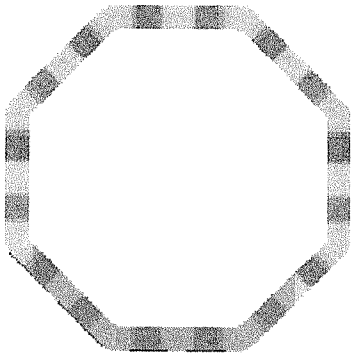
FIG. 9C shows an expanded auxetic beam having an octagonal cross section.
Figure 9D:
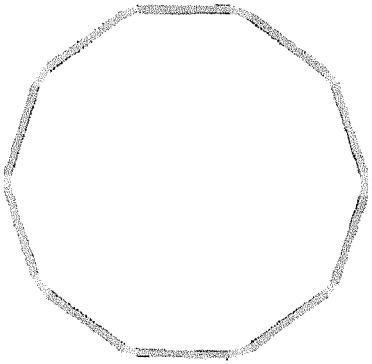
FIG. 9D shows an expanded auxetic beam having a 10-sided cross section.

FIG. 8 depicts the nested-V cell used in a cylindrical configuration to construct a honeycomb auxetic beam, in this case having a generally hexagonal cross section. Such beams may be used in conjunction with the panels described herein to hold up roof structures, for example. As with the panel structures, the outside and/or inside surfaces of such beams may be fabric-covered.

Figure 10:
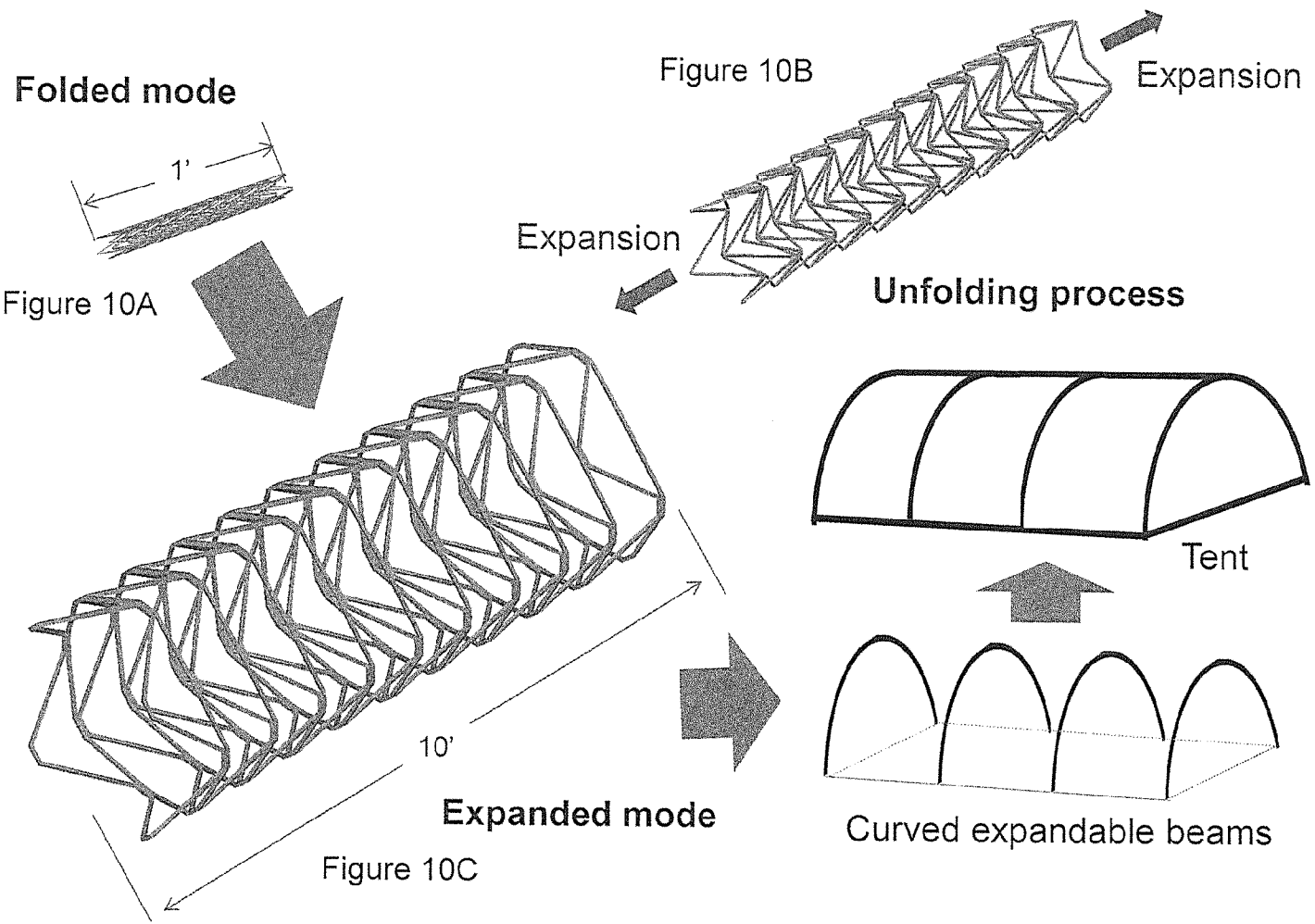
FIGS. 10A-10C illustrate a mean unfolding mechanism that may be used to form curved beams to construct a tent or other structure.
Figure 11:
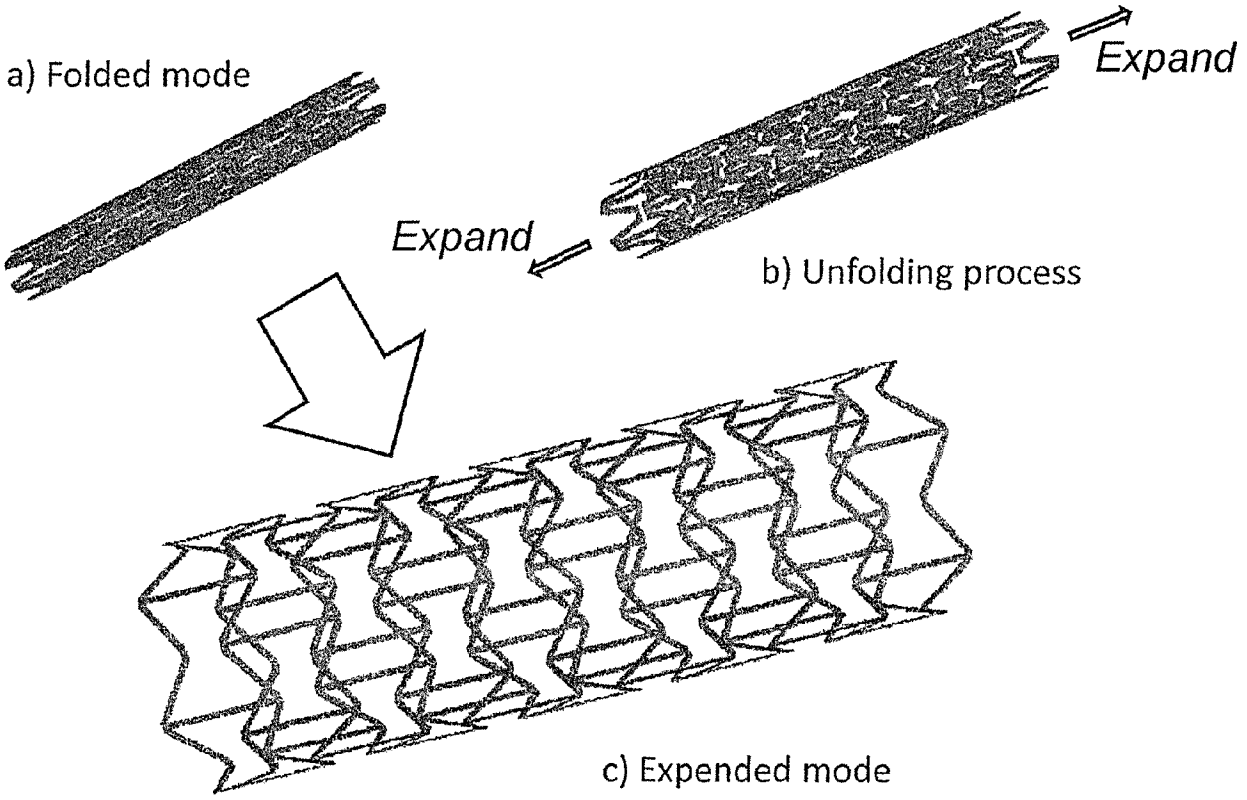
FIG. 11 illustrates the unfolding of an X-type auxetic beam.

As shown in FIG. 9, square, octagonal and other cross-sectional shapes are possible for beam constructions. FIG. 9A shows an expanded auxetic beam having a square cross section; FIG. 9B shows an expanded auxetic beam having a hexagonal or honeycomb cross section; FIG. 9C shows an expanded auxetic beam having an octagonal cross section; and FIG. 9D shows an expanded auxetic beam having a 10-sided cross section;

FIGS. 10A-10C illustrate a beam unfolding mechanism. In FIG. 10A, in the folded mode the beam may only be a foot long. The structure undergoes expansion in all directions in FIG. 10B, leading to a fully expanded shape in FIG. 10C that may be used for Quonset-type huts, tents, and other such structures. FIG. 11 illustrates the unfolding of an X-type auxetic beam.

Figure 12:
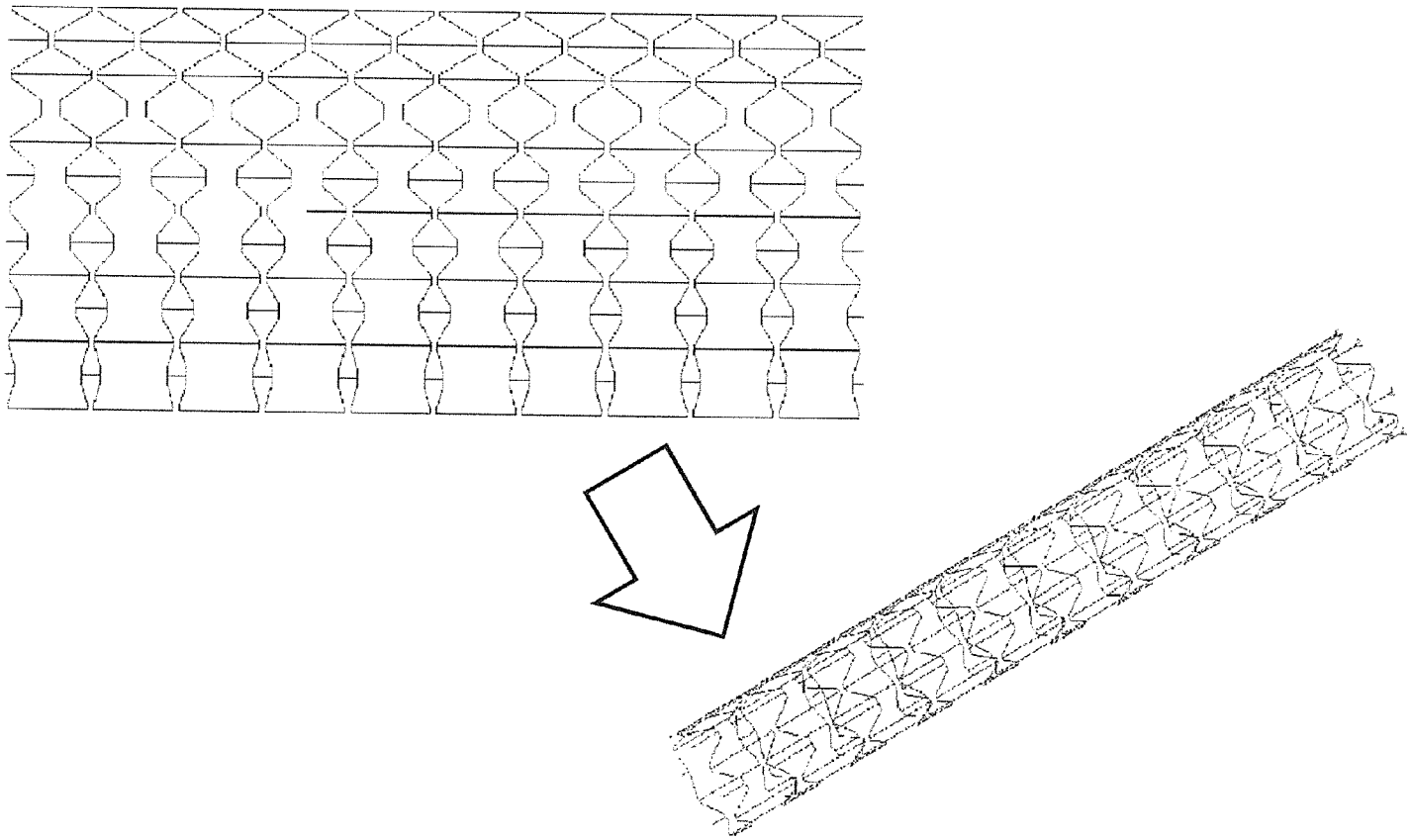
FIG. 12 shows a curved expandable beam with variable NPR cells along a circular cross section.
Figure 13:
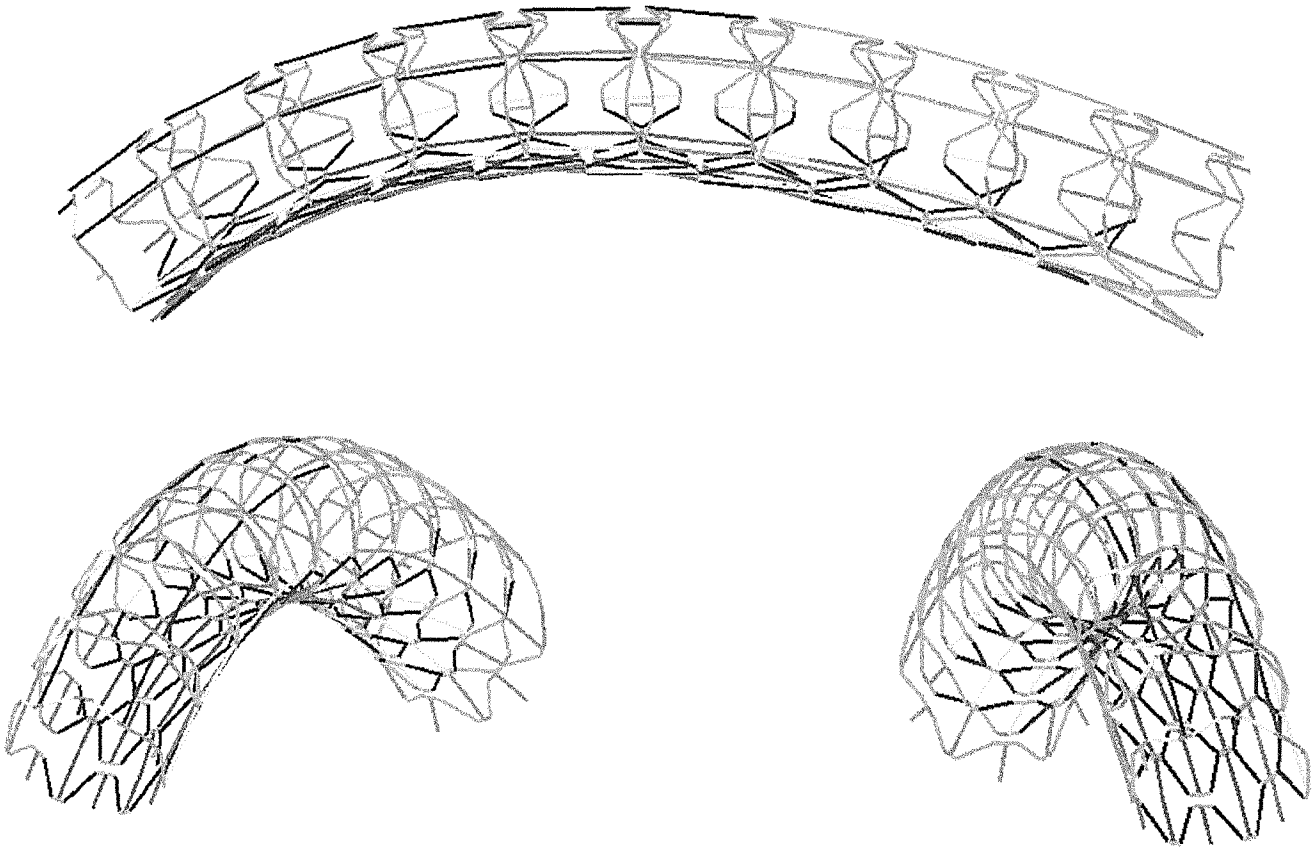
FIG. 13 depicts how a curved tube may be achieved by distributing variable NPR cells around a form having a circular cross section.

FIG. 12 shows a curved expandable beam with variable NPR cells along the circle. With this transition in differently sized unit cells, either a straight beam may be constructed, as shown in FIG. 12, as illustrated in FIG. 13, the beam may form a curved shape by properly distributing variable NPR cells around a circle.

Figure 14A:
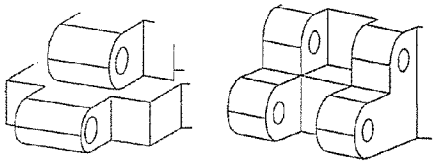
FIG. 14A is a top view of an alternative N-axle joint body.
Figure 14A:
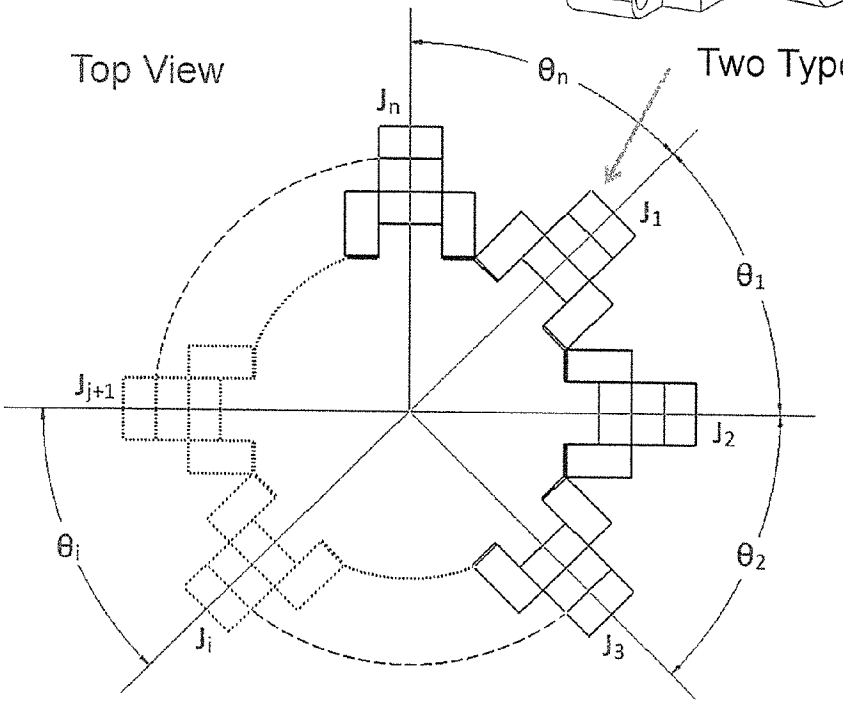
Figure 14B:
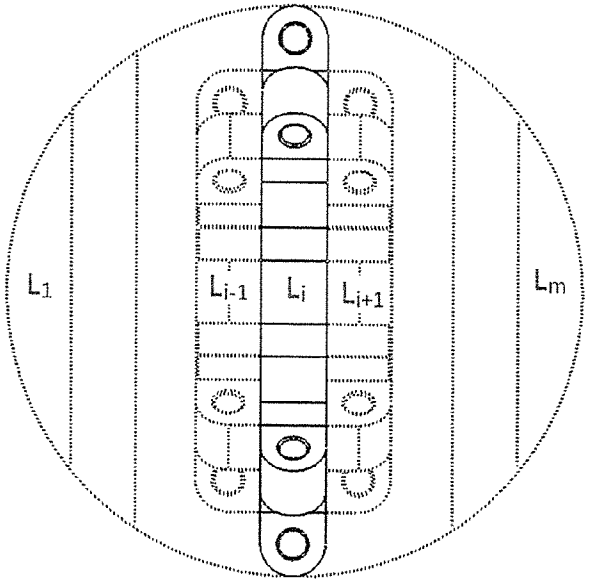
FIG. 14B is a side view of the joint body of FIG. 14A showing how M layers may be provided.
Figure 15:
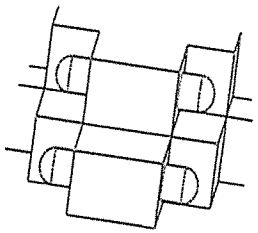
FIG. 15 shows joint types having male-female, female-female, female-male and male-male interconnection configurations.
Figure 15:
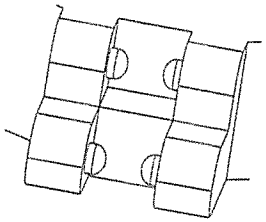
Figure 15:
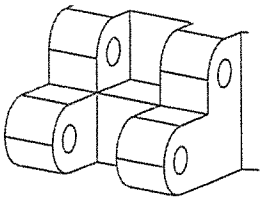
Figure 15:
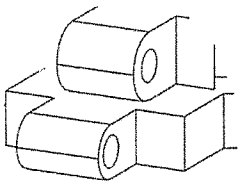

FIG. 14 illustrates the general concept for the joint. In particular, FIG. 14A is a top view of an alternative N-axle joint body, and FIG. 14B is a side view of the joint body of FIG. 14A showing how M layers may be provided. In this context, M layers refers to different levels or planes which, in the preferred embodiments are substantially parallel to one another. Each of the joint bodies shown in FIG. 14 may utilize any number of different joint types as shown in the diagram of FIG. 15; for example, joint types having male-female, female-female, female-male and male-male interconnection configurations. Extensions $J_n$-$J_{jt1}$ may be at the same or different angles $\theta_n$-$\theta_i$.

Figure 16:
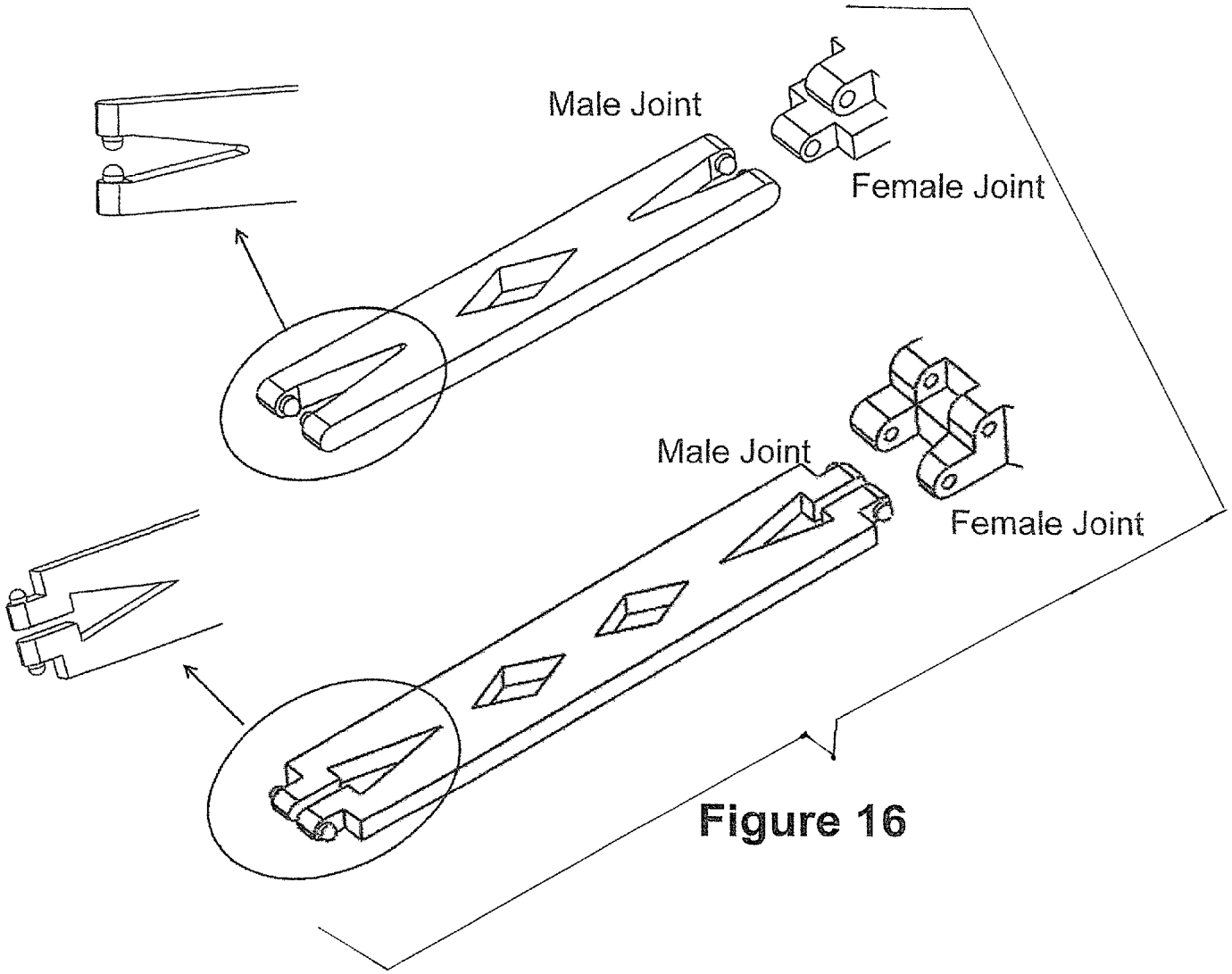
FIG. 16 illustrates a first set of possible clicking joints.
Figure 17:
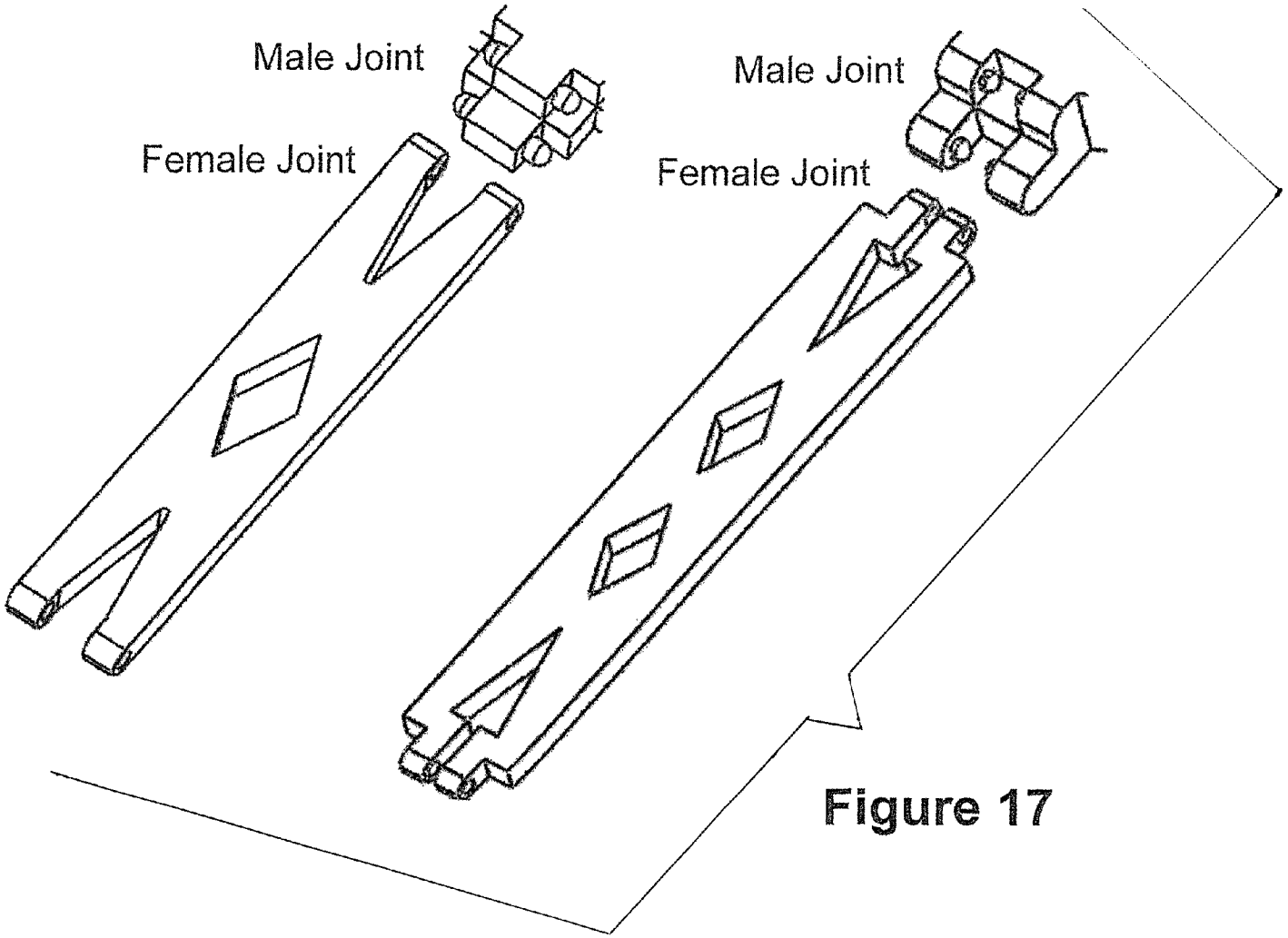
FIG. 17 illustrates a second set of possible clicking joints.
Figure 18:
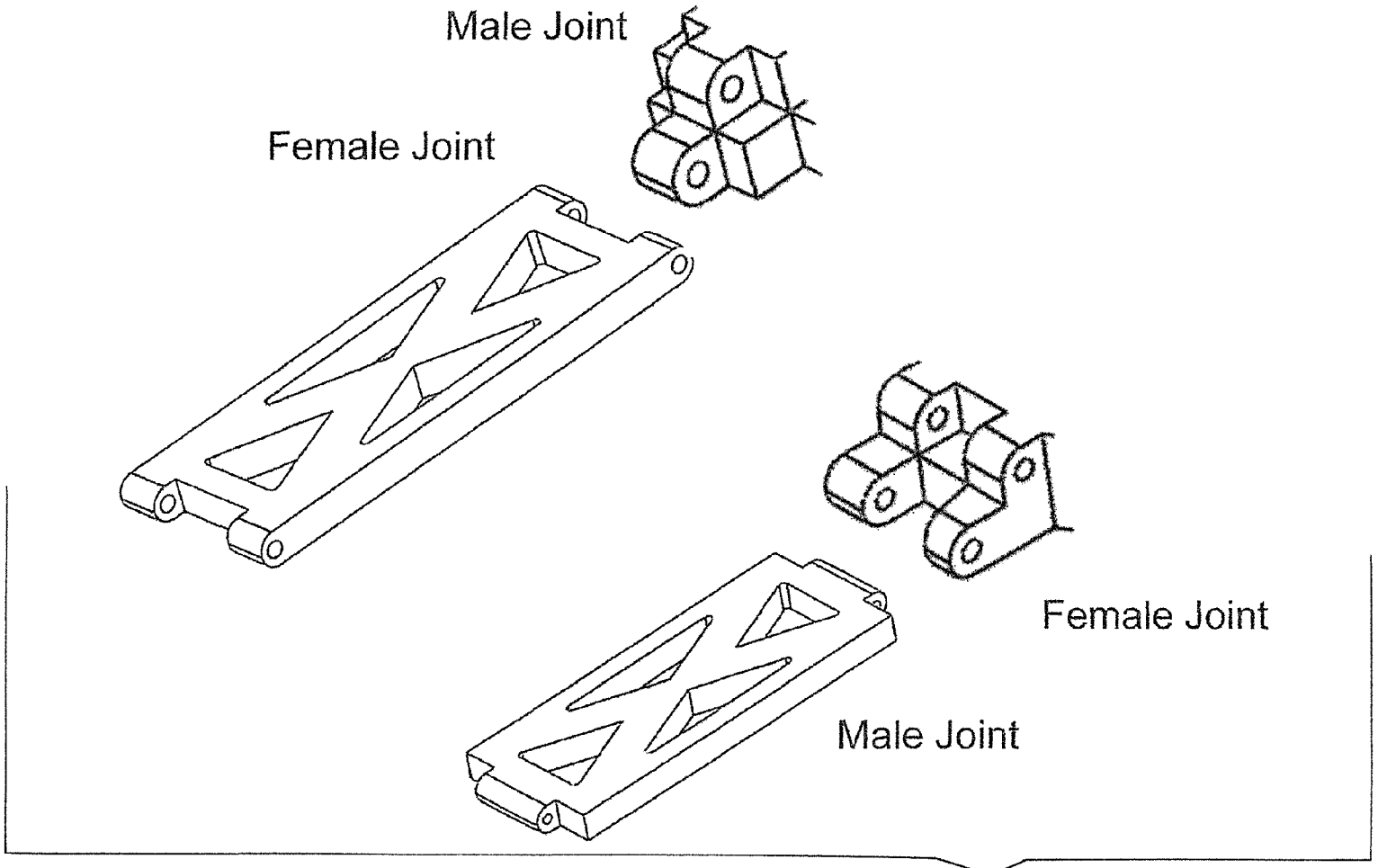
FIG. 18 illustrates different types of pin connection features.
Figure 19:
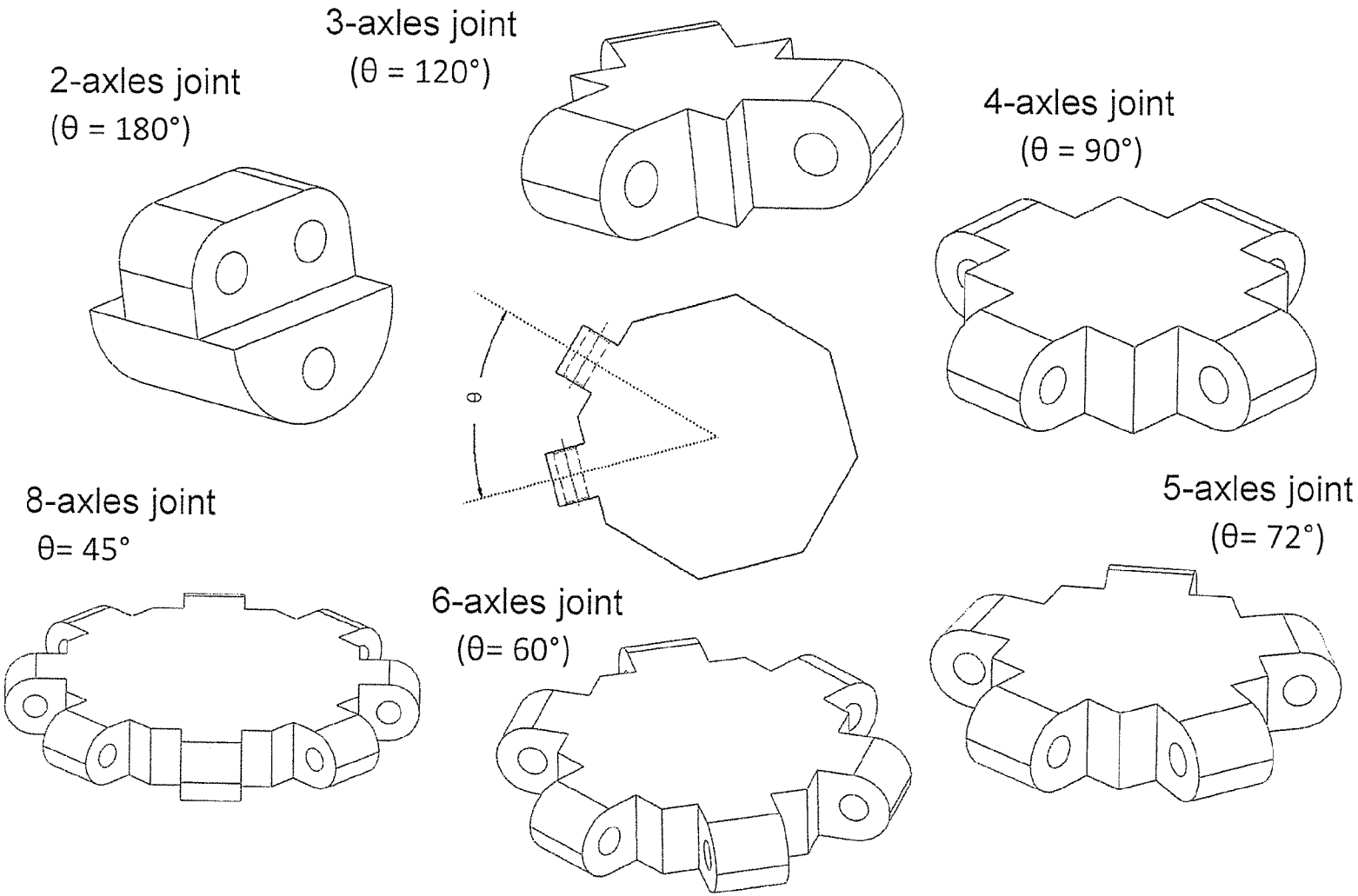
FIG. 19 shows examples of one-layer joints.
Figure 20:
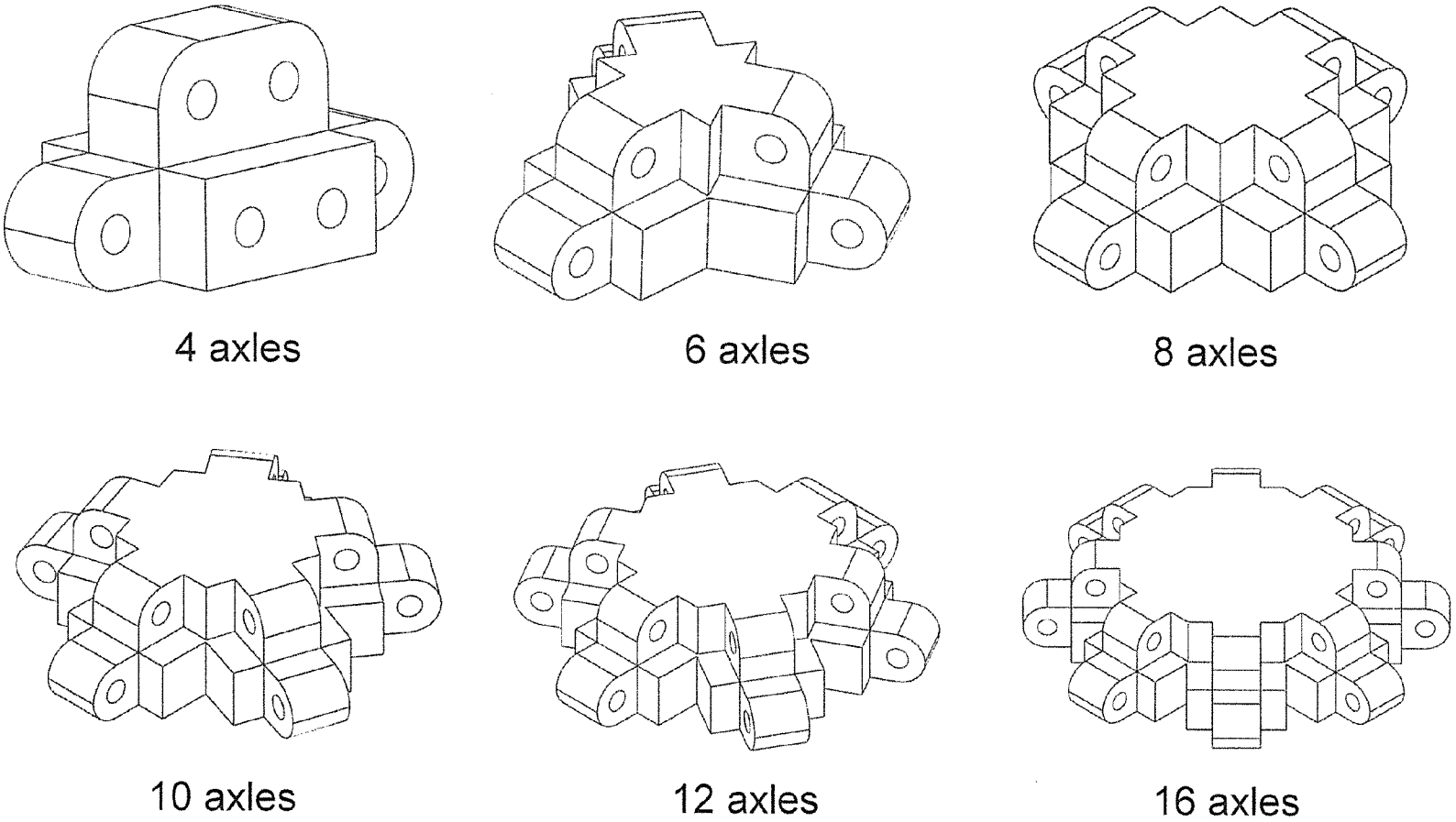
FIG. 20 shows examples of two-layer joints.
Figure 21:
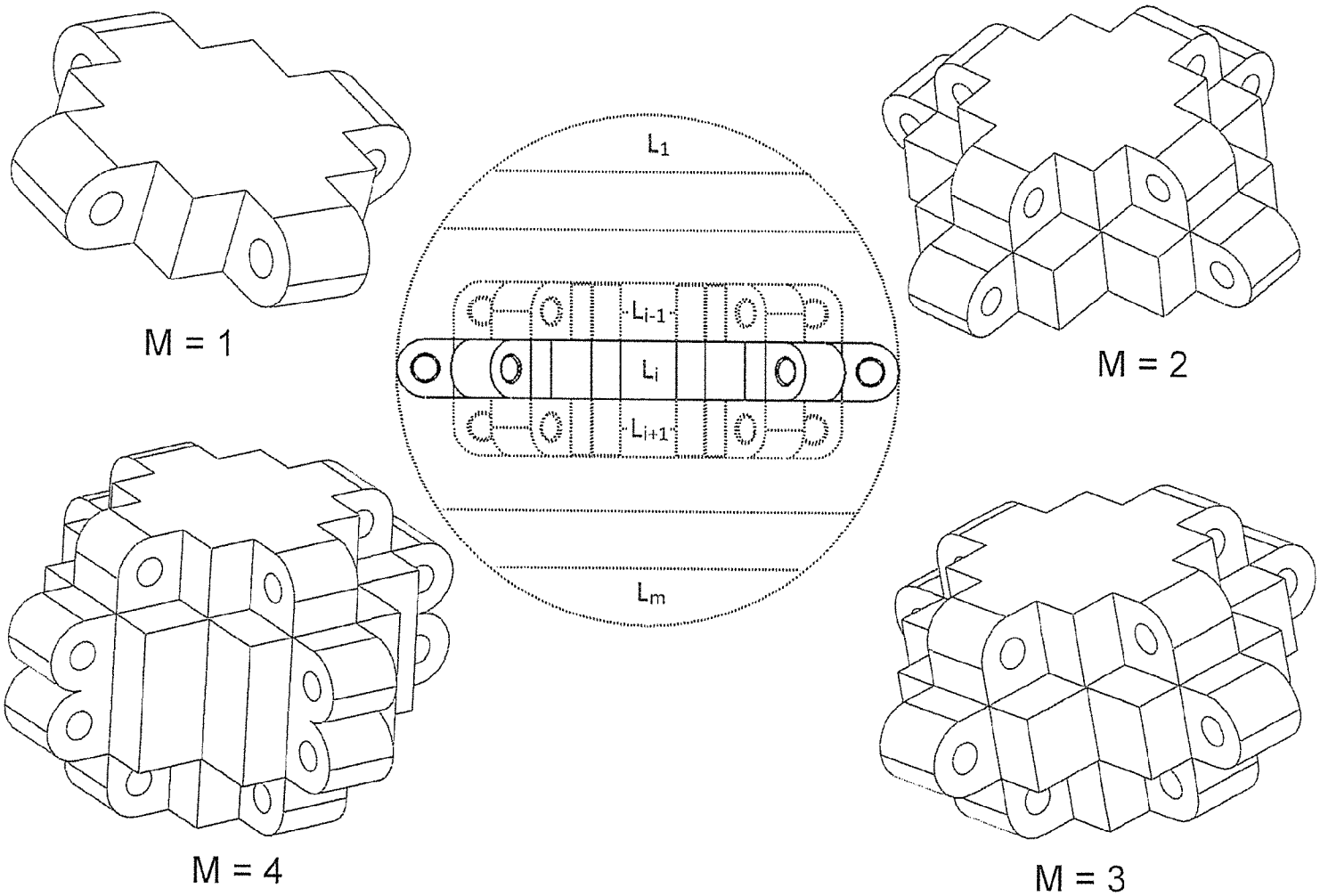
FIG. 21 depicts joint bodies having 1 to 4 layers.
Figure 22:
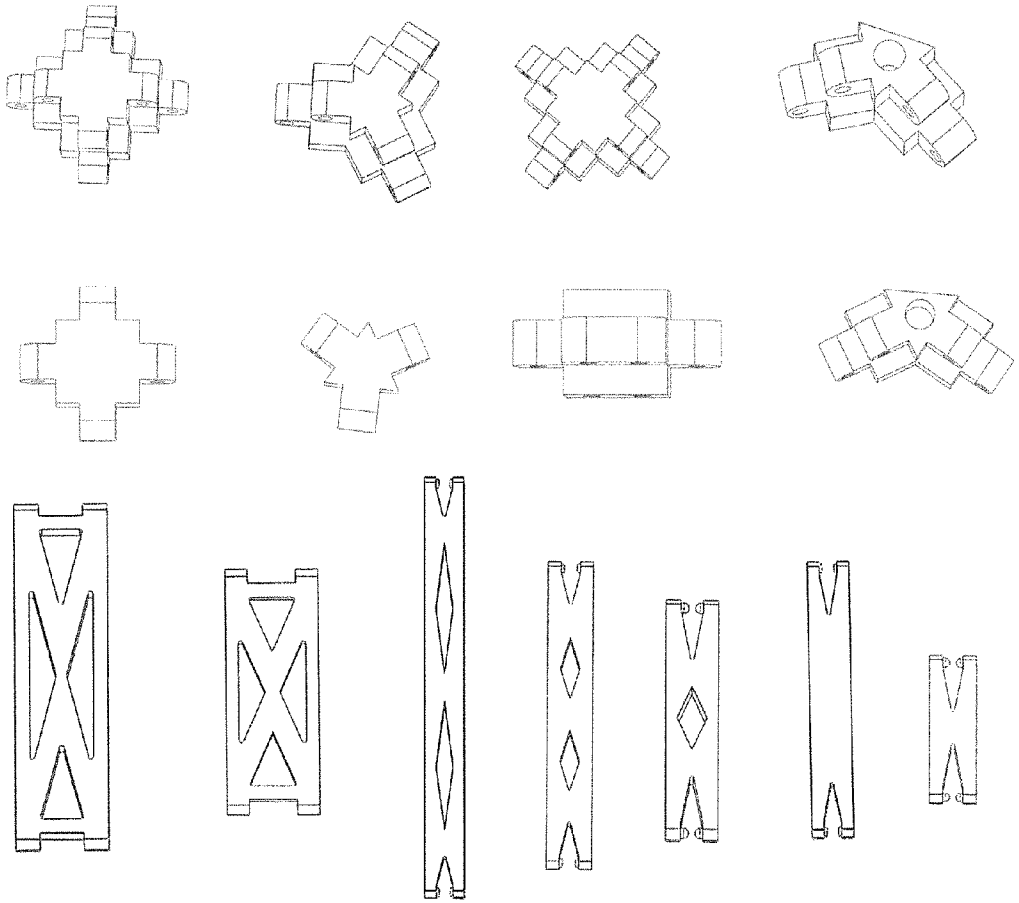
FIG. 22 illustrates a variety of fabricated joints and interconnecting members.

FIGS. 16 and 17 illustrate various possible clicking joints constructed in accordance with the invention, while FIG. 18 illustrates different types of pin connection features. FIG. 19 shows examples of possible one-layer joints, and FIG. 20 shows examples of possible two-layer joints. FIG. 21 depicts joint bodies having up to 4 layers with the understanding that additional level are possible with sufficient stepped outer profiling.

Figure 23:
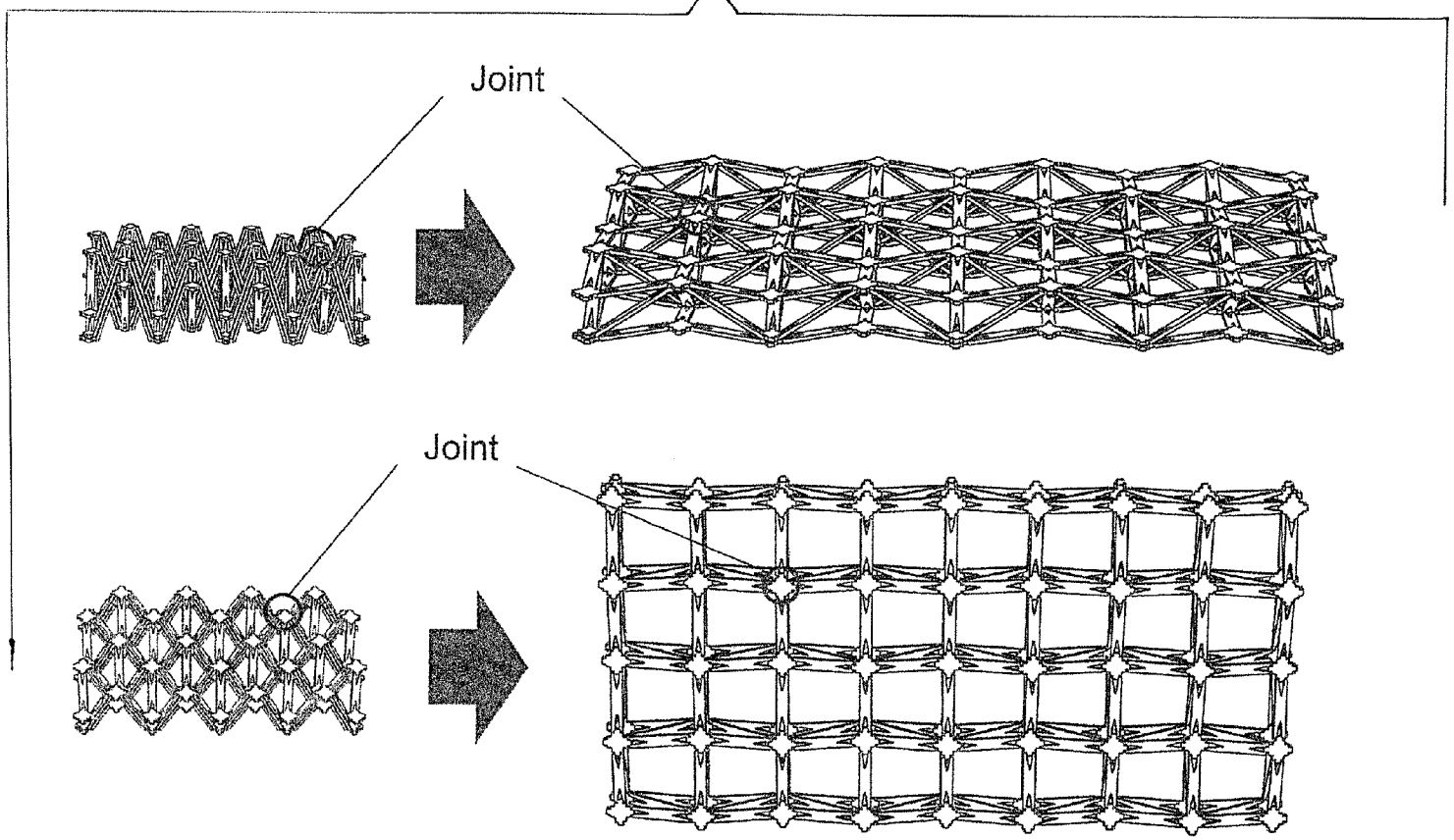
FIG. 23 depicts an expandable panel based upon a two-layer, eight-axle joint bodies.
Figure 24:
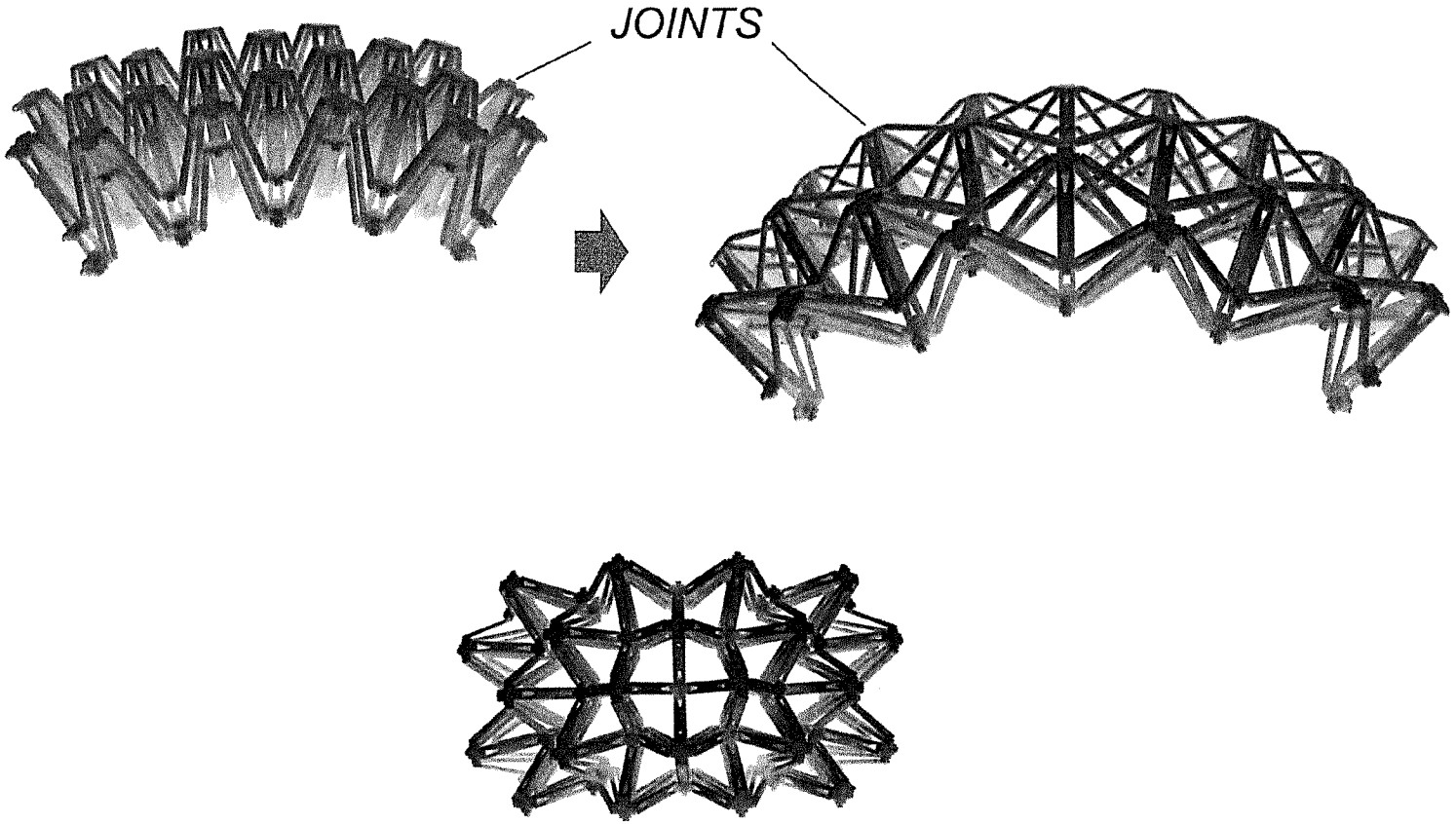
FIG. 24 shows how the structure of FIG. 25 have be formed into an arch configuration.
Figure 25:
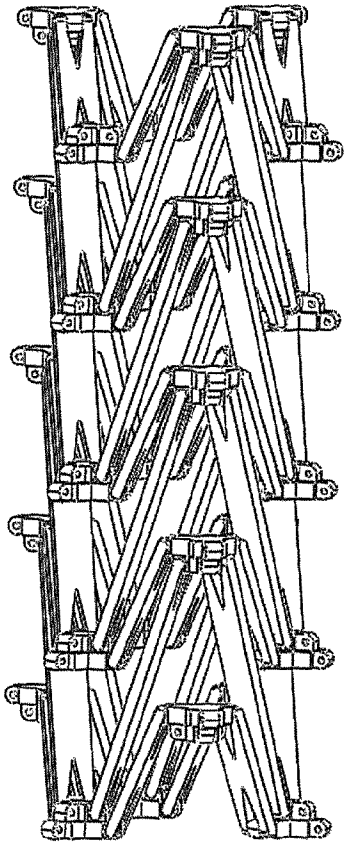
FIG. 25 depicts expandable beams based upon two-layer, four-axle joint bodies.
Figure 26:
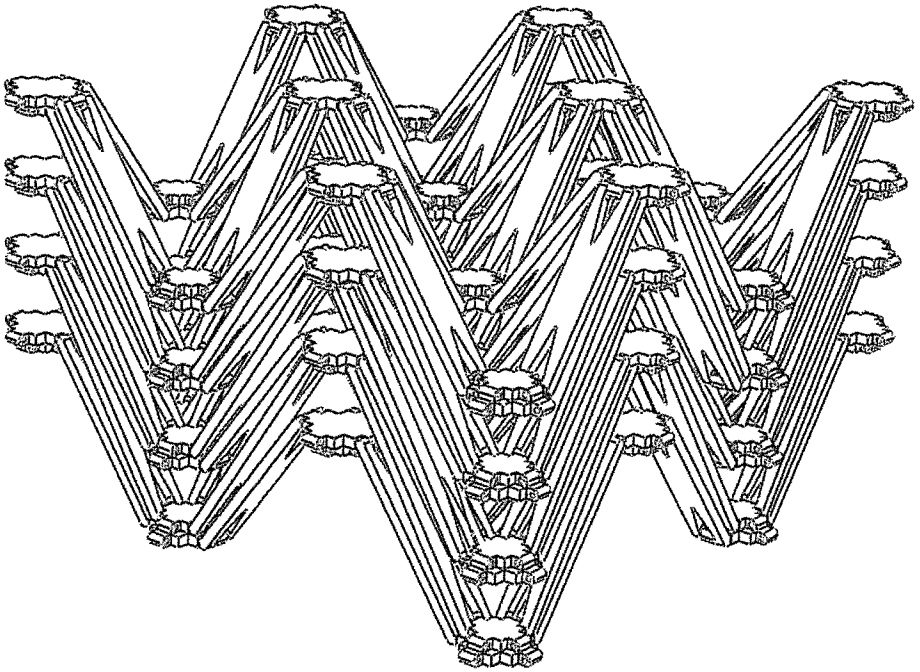
FIG. 26 shows a multi-layered expandable panel based upon two-layer, eight-axle joint bodies.

In terms of specific structures, FIG. 23 depicts an expandable panel based upon a two-layer, eight-axle joint bodies, and FIG. 24 shows how the structure of FIG. 23 may be formed into an arch configuration. FIG. 25 depicts expandable beams based upon two-layer, four-axle joint bodies, and FIG. 26 shows a multi-layered expandable panel based upon two-layer, eight-axle joint bodies.

Figure 27:
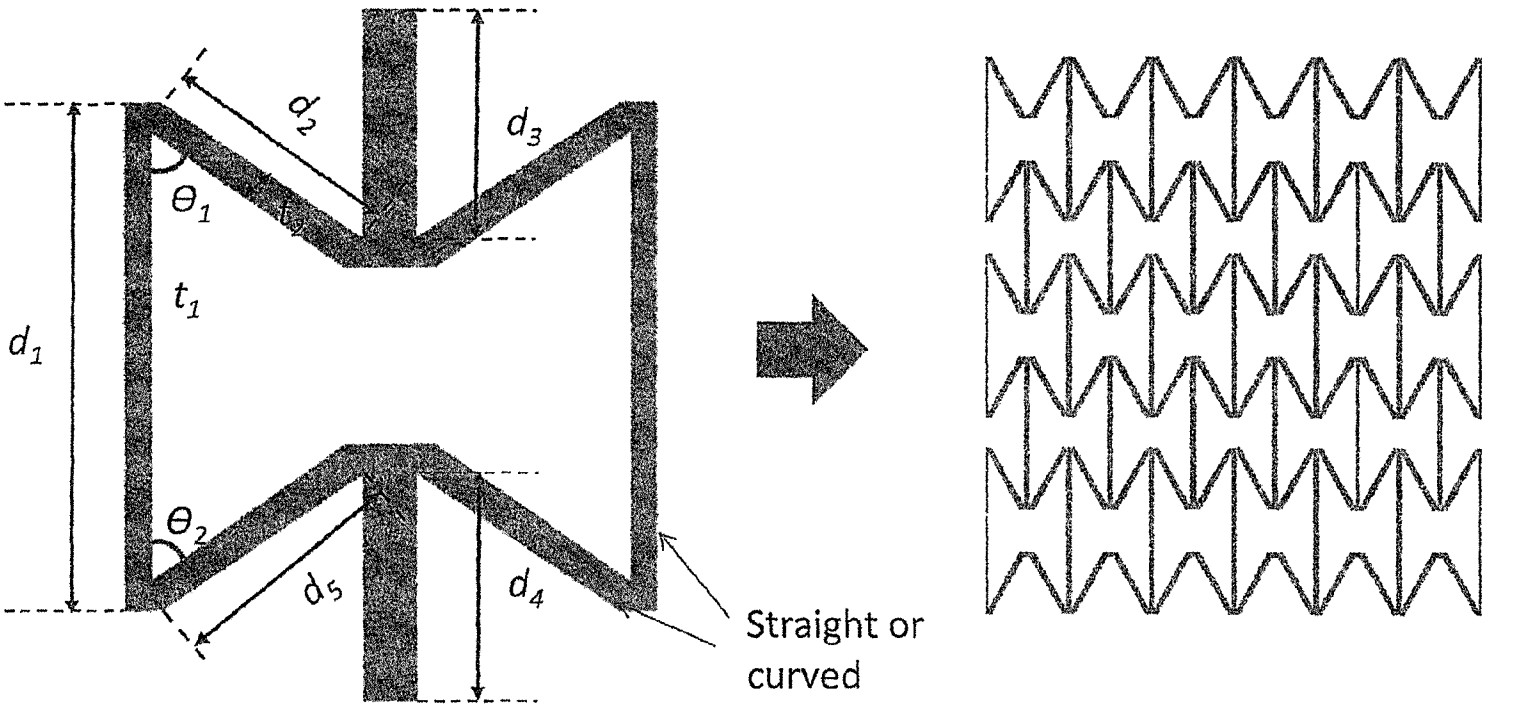
FIG. 27 illustrates a collapsible-expandable panel based upon X-type auxetic unit cells.

It will be appreciated that multiple variations are possible beyond the structures so far described. As previously described, FIG. 27 illustrates a collapsible-expandable panel based upon X-type auxetic unit cells. The members defining the expandable structure linkages may use different for "stuffer" members and "tensor" members, with dimensions $d_1$-$d_5$, shapes, topologies, cross-sections $t_1$-$t_2$, angles $\theta_1$-$\theta_2$, and material usages being defined by the intended application. The members defining the expandable structure may be made of 'active' materials, including shape-memory alloys such as Nitinol. Further, the members defining the expandable structure may include actuators and mechanical or electronic locking provisions associated with the joints and/or linkages.

I claim:

1. An expandable-collapsible structure, comprising:

a plurality of joint bodies, each joint body having a plurality of connection features;

a plurality of interconnecting link members with opposing ends, each end including connection features that engage with the connection features of the joint bodies such that the link members pivot about different axes relative to the joint bodies, thereby forming an expandable and collapsible structure having a height and a width;

wherein the link members form an array of geometric unit cells, each unit cell comprising nested, expanding and contracting upper and lower V shapes;

wherein each upper V shape includes first and second upper members A, B interconnected with an upper joint body, and each lower V shape includes first and second lower members C, D interconnected with a lower joint body, wherein the first upper member (A) and the first lower member (C) are interconnected through a first side joint body, and the second upper member (B) and the second lower member (D), are connected to a second side joint body, wherein the upper members A, B are the same length, and the lower members C, D are the same length but longer that the upper members A, B, such that the upper joint body is disposed directly above the lower joint body forming a nested-V unit cell, and wherein the upper, lower and side joint bodies are further connected to additional, respective nested V unit cells forming an auxetic structure; and wherein the height and the width of the structure when expanded are both greater than the height and the width of the structure when collapsed.

2. The structure of claim 1, wherein some of the interconnecting link members form parallel, straight lines when the structure is expanded.

3. The structure of claim 1, wherein the interconnecting link members have side edges which are proximate to one another or touching only when the structure is collapsed.

4. The structure of claim 1, wherein the interconnecting link members are rigid or flexible.

5. The structure of claim 1, wherein the interconnecting link members are straight or curved.

6. The structure of claim 1, wherein the interconnecting link members have uniform or varied cross sections.

7. The structure of claim 1, wherein the joint bodies with the connection features that provide pivot axes arranged on different levels or planes.

8. The structure of claim 1, further including a flexible sheet of material adhered to the joint bodies, link members, or both, thereby forming a covered panel when the structure is expanded.

9. The structure of claim 1, further including:

a flexible sheet of material adhered to the joint bodies, link members, or both, thereby forming a covered panel when the structure is expanded; and wherein the material is waterproof or weather-resistant.

10. The structure of claim 1, further including:

a plurality of panels form by adhering a flexible sheet of material adhered to the joint bodies, link members, or both; and wherein the panels are arranged to form a building, tent, shelter, storage unit, mobile house, vehicle body or other enclosure.

11. The structure of claim 1, wherein the connection features that provide one or more of the following different physical configurations:

the joint body connection features disposed on multiple layers, planes or levels, the joint body connection features extending radially outwardly at a plurality of different angles, the connection features between the joint bodies and the interconnecting link members being male-female, female-female, female-male or male-male, and the connection features between the joint bodies and the interconnecting link members being pin-type connections.

12. The structure of claim 1, wherein the connection features are posts or projections and holes or recesses configured to receive the posts or projections.

13. The structure of claim 1, wherein the connection features include pins disposed along the pivot axes.

14. The structure of claim 1, wherein:

the ends of the link members include two arms with connection features; and the arms are temporarily spread apart to engage with the connection features on the joint bodies.

15. The structure of claim 1, wherein:

the link members form an array of geometric unit cells having a periodicity when the structure is expanded; and the periodicity varies in one or more dimensions.

16. The expandable structure of claim 1, wherein:

the number of unit cells within a layer of unit cells defines a height of the layer; and unit cells in all layers have the same height.

17. The expandable structure of claim 1, wherein:

the number of unit cells within a layer of unit cells defines a height of the layer; and the unit cells in different layers have the different heights.

18. The expandable structure of claim 1, wherein:

the number of unit cells within a layer of unit cells defines a height of the layer; and the unit cells in the same layer have the different heights.

19. The expandable structure of claim 1, wherein:

the unit cells defines a width when the structure is expanded; and the width is uniform or variable in one or more dimensions.

20. The expandable structure of claim 1, wherein the link members defining the expandable structure are constructed from metals, ceramics, fiber-reinforced composite materials, polymer matrix materials, plastics, or fibers.

21. The expandable structure of claim 1, further including foam or other filler material surrounding the link members.

22. The expandable structure of claim 1, wherein:

the structure has an outermost surface when expanded; and the outermost surface is cylindrical or curved in multiple dimensions.

23. The expandable structure of claim 1, wherein:

the link members have cross sections; and the cross sections define solid or hollow rods or tubes, flat or curved plates or strips, or U-shaped, T-shaped, V-shaped or I-shaped beams.

* * * * *